US009897970B2

(12) United States Patent
Oshima et al.

(10) Patent No.: US 9,897,970 B2
(45) Date of Patent: Feb. 20, 2018

(54) DEVELOPER CONTAINER, DEVELOPING DEVICE, PROCESS CARTRIDGE AND IMAGE FORMING APPARATUS

(71) Applicant: CANON KABUSHIKI KAISHA, Tokyo (JP)

(72) Inventors: Nobuo Oshima, Inagi (JP); Takayuki Namiki, Yokohama (JP); Masanori Tanaka, Yokohama (JP); Yuta Isobe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/163,702

(22) Filed: May 25, 2016

(65) Prior Publication Data

US 2016/0349669 A1 Dec. 1, 2016

(30) Foreign Application Priority Data

May 26, 2015 (JP) ..... 2015-105995

(51) Int. Cl.
*G03G 15/08* (2006.01)
*G03G 21/18* (2006.01)

(52) U.S. Cl.
CPC ..... *G03G 21/1814* (2013.01); *G03G 15/0882* (2013.01); *G03G 15/0889* (2013.01)

(58) Field of Classification Search
CPC ..... G03G 15/0872; G03G 15/0886; G03G 15/0865; G03G 15/0882; G03G 15/0881; G03G 15/0874; G03G 15/0898; G03G 15/0877; G03G 21/1676; G03G 2215/0682; G03G 2215/0687; G03G 15/0841; G03G 15/0868
See application file for complete search history.

(56) References Cited

U.S. PATENT DOCUMENTS

| | | | | |
|---|---|---|---|---|
| 5,126,800 | A | 6/1992 | Shishido et al. | |
| 5,208,634 | A | 5/1993 | Ikemoto et al. | |
| 5,345,294 | A | 9/1994 | Nomura et al. | |
| 5,623,328 | A | 4/1997 | Tsuda et al. | |
| 5,828,928 | A | 10/1998 | Sasago et al. | |
| 6,465,143 | B2 | 10/2002 | Tanaka et al. | |
| 6,963,714 | B2 | 11/2005 | Otomo et al. | |
| 7,071,962 | B2 | 7/2006 | Fujii et al. | |
| 7,639,956 | B2 | 12/2009 | Naito et al. | |
| 7,692,804 | B2 | 4/2010 | Naito et al. | |
| 8,953,985 | B2 | 2/2015 | Namiki | |
| 9,057,973 | B2 | 6/2015 | Oshima et al. | |
| 2014/0086620 | A1* | 3/2014 | Takeuchi | G03G 15/0882 399/106 |

FOREIGN PATENT DOCUMENTS

| | | | |
|---|---|---|---|
| JP | H05-197288 | A | 8/1993 |
| JP | 2014-066967 | A | 4/2014 |

* cited by examiner

*Primary Examiner* — Roy Y Yi
(74) *Attorney, Agent, or Firm* — Fitzpatrick, Cella, Harper & Scinto

(57) ABSTRACT

A developer container includes a frame, provided with an opening, for accommodating a developer; a sealing member, including a folded-back portion, for sealing the opening; and a sandwiching portion for sandwiching the folded-back portion of the sealing member. In a plane perpendicular to the opening, the sealing member is nonwelded in the sandwiching portion.

18 Claims, 22 Drawing Sheets

(a)

(b)

(a)

(b)

(a)

(b)

(a)

(b)

(a)

(b)

(a)

(b)

(a)

(b)

DEVELOPER CONTAINER, DEVELOPING DEVICE, PROCESS CARTRIDGE AND IMAGE FORMING APPARATUS

FIELD OF THE INVENTION AND RELATED ART

The present invention relates to a developer container, a developing device, a process cartridge and an image forming apparatus.

Here, the developer container is a container for accommodating a developer carrying member, for visualizing an electrostatic latent image with the developer. Further, the developer container is used alone so as to be detachably mountable to the image forming apparatus.

Further, the process cartridge refers to a cartridge constituted by integrally assembling at least the developer container and the developer carrying member into a unit, which is detachably mountable to an image forming apparatus main assembly.

Examples of the image forming apparatus may include an electrophotographic copying machine, an electrophotographic printer (such as an LED printer or a laser beam printer) and an electrophotographic facsimile machine, in which an image is formed on a recording material (medium) by using an electrophotographic image forming process.

In the image forming apparatus using the electrophotographic image forming process, a process cartridge type in which an electrophotographic photosensitive drum and a process means actable on the drum into a cartridge (unit), which is detachably mountable to the image forming apparatus main assembly is employed. According to this process cartridge type, maintenance of the apparatus can be performed by a user himself (herself) without relying on a service person, and therefore operativity was able to be considerably improved. For that reason, this process cartridge type has widely been used in the image forming apparatuses.

Such a process cartridge includes a developer accommodating portion for accommodating a toner as the developer for visualizing a latent image formed on the photosensitive drum and a developing unit including a developing means for developing the latent image with the toner. During a brand-new state of the process cartridge including the developing unit, a toner sealing member for preventing the developer in the developer accommodating portion from entering a developing unit side through an opening provided in the developer accommodating portion is provided. For that reason, when the user uses the process cartridge, the user peels off the toner sealing member from the process cartridge and then mounts the process cartridge in the image forming apparatus main assembly.

Further, in recent years, from the viewpoint of usability, a constitution in which the toner sealing member is peeled off only by mounting the process cartridge into the image forming apparatus main assembly is disclosed (Japanese Laid-Open Patent Application (JP-A) Hei 5-197288 and JP-A 2014-66967). In this constitution, one end portion of the toner sealing member is mounted on a rotatable member in the developer accommodating portion and the toner sealing member is automatically wound up around the rotatable member with drive of the image forming apparatus main assembly, so that the toner can be sent to the developing unit.

However, in the constitution in which the toner sealing member provided on the opening of the toner accommodating portion is pulled by rotational drive of the image forming apparatus main assembly, there was a problem that a torque when the toner sealing member was pulled was large. This is because when the toner sealing member is pulled, a force for peeling off a welded portion between the developer accommodating portion and the toner sealing member is needed. The welded portion is portion where an adhesive layer is provided on the toner sealing member and then heated and welted at the opening of the developer accommodating portion and thus is bonded to a periphery of the opening, so that the opening is completely closed (blocked) using the welded portion and thus toner leakage is prevented. However, from the viewpoints of energy saving and downsizing in recent years, there arose a need to reduce the torque, when the toner sealing member was pulled, to the possible extent.

SUMMARY OF THE INVENTION

A principal object of the present invention is to reduce a torque when a toner sealing member is pulled while preventing toner leakage from a developer accommodating portion before a user uses an image forming apparatus.

According to an aspect of the present invention, there is provided a developer container comprising: a frame, provided with an opening, for accommodating a developer; a sealing member, including a folded-back portion, for sealing the opening; and a sandwiching portion for sandwiching the folded-back portion of the sealing member, wherein in a plane perpendicular to the opening, the sealing member is nonwelded in the sandwiching portion.

Further features of the present invention will become apparent from the following description of exemplary embodiments with reference to the attached drawings.

DESCRIPTION OF THE EMBODIMENTS

Embodiments for carrying out the present invention will be specifically described with reference to the drawings. Dimensions, materials, shapes and relative arrangement of constituent elements described in the following embodiment should be appropriately be changed depending on structures and various conditions of devices (apparatuses) to which the present invention is applied. Accordingly, the scope of the present invention is not intended to be limited to the following embodiments.

[Embodiment 1]

An image forming apparatus to which a cartridge according to this embodiment is detachably mountable will be described. In this embodiment, as the image forming apparatus, a laser beam printer using electrophotography will be described as an example.

(Structure of Image Forming Apparatus)

Figure 2:
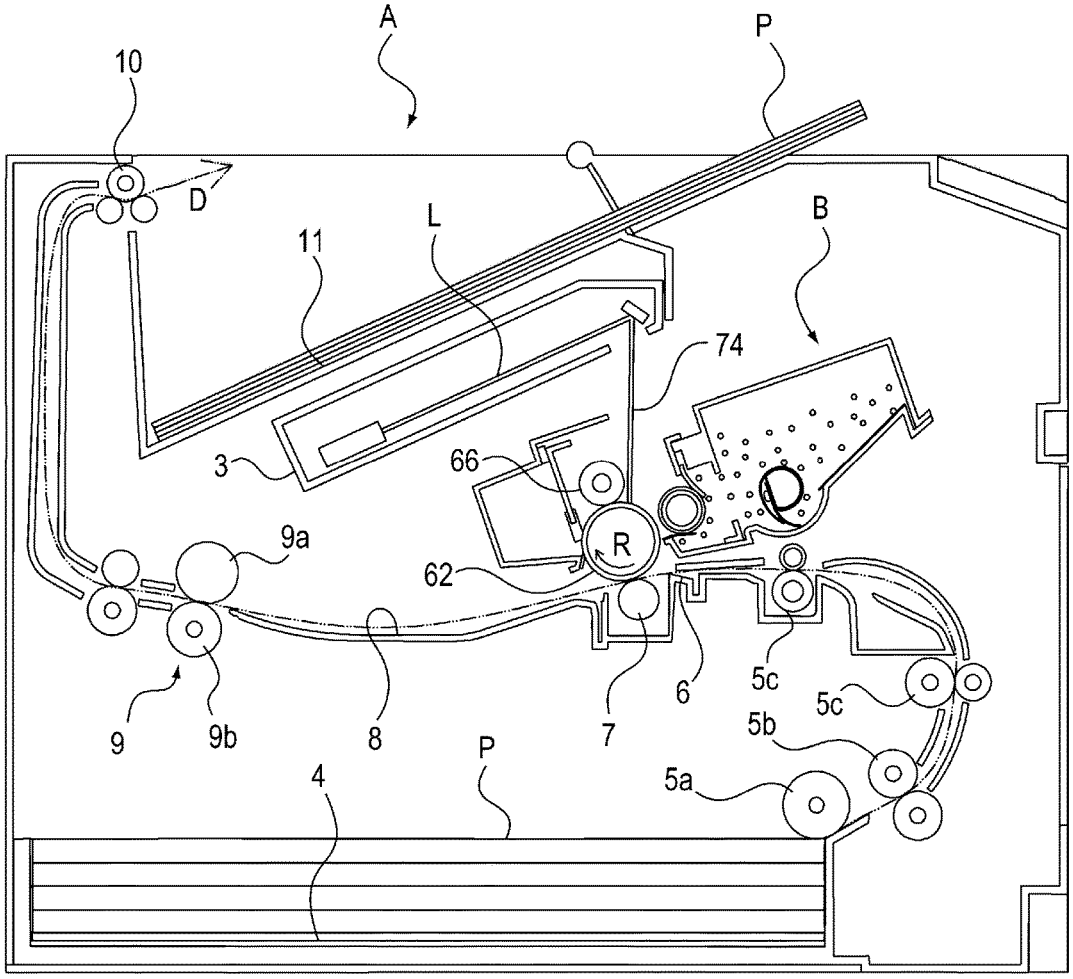
FIG. 2 is a sectional view of an image forming apparatus in Embodiment 1.

In FIG. 2, the image forming apparatus in this embodiment is the laser beam printer, using the electrophotography, in which a cartridge B is detachably mountable to an apparatus main assembly A. When the cartridge B is mounted in the apparatus main assembly A, above the cartridge B, an exposure device 3 (laser scanner unit) is provided. Further, below the cartridge B, a sheet tray 4 in which a recording material (sheet material P) to be subjected to image formation is accommodated is provided.

Further, in the apparatus main assembly A, along a feeding direction D of the sheet material P, a pick-up roller 5*a*, a feeding roller pair 5*b*, conveying roller pairs 5*c*, a transfer guide 6, a transfer roller 7, a conveying guide 8, a fixing device 9, a discharging roller pair 10, a discharge tray 11 and the like are successively provided. Incidentally, the fixing device 9 is constituted by a heating roller 9*a* and a pressing roller 9*b*.

(Image Forming Process Operation)

Next, the image forming process will be described using FIGS. 2 and 3. On the basis of a print start signal, an electrophotographic photosensitive drum 62 is rotationally driven at a predetermined peripheral speed (process speed: 215 mm/sec) in an arrow R direction in FIG. 2. A charging roller 66 to which a charging bias voltage is applied contacts an outer peripheral surface of the drum 62 and electrically charges the outer peripheral surface of the drum 62 uniformly. The exposure device 3 outputs laser light L depending on image information. The laser light L passes through an exposure window portion 74 provided at an upper surface of the cartridge B, so that the outer peripheral surface of the drum 62 is subjected to scanning exposure. As a result, on the outer peripheral surface of the drum 62, an electrostatic latent image depending on the image information is formed.

Figure 3:
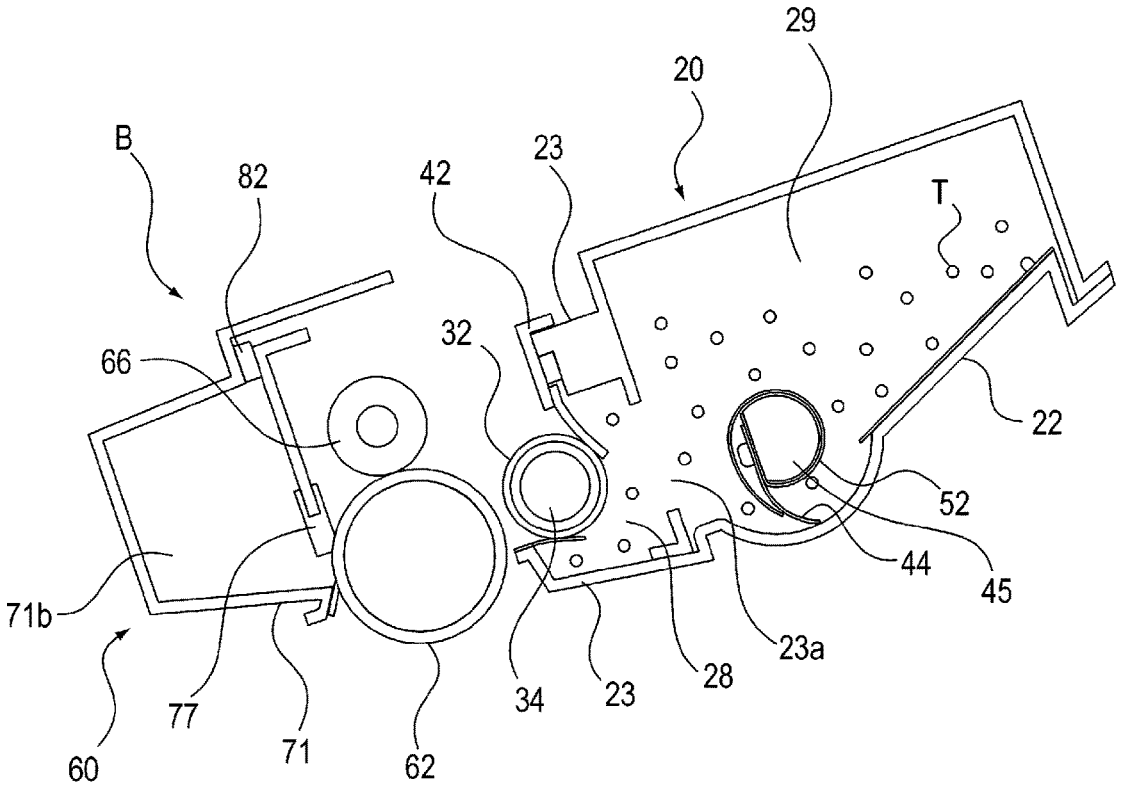
FIG. 3 is a sectional view of a cartridge in Embodiment 1.

On the other hand, as shown in a sectional view of the cartridge in FIG. 3, in a developing device unit 20 as a developing device, a toner T in a toner chamber 29 is stirred and fed by rotation of a rotatable member 45, so that the toner T is sent to a toner supplying chamber 28. The toner T is carried by a magnetic force of a magnet roller 34 (fixed magnet) on a surface of a developing roller (developer carrying member) 32. The toner T is regulated in layer thickness on the peripheral surface of the developing roller 32 by a developing blade 42 while being triboelectrically charged. The toner T is transferred onto the drum 62 depending on the electrostatic latent image, so that the electrostatic latent image is visualized as a toner image which is a developer image.

Further, as shown in FIG. 2, in synchronism with output timing of the laser light L, by the pick-up roller 5*a*, the feeding roller pair 5*b* and the conveying roller pair 5*c*, the sheet material P accommodated at a lower portion of the apparatus main assembly A is fed from the sheet tray 4. The sheet material P is supplied to a transfer position between the drum 62 and the transfer roller 7 via the transfer guide 6. In this transfer position, the toner image is successively transferred from the drum 62 onto the sheet material P. The sheet material P on which the toner image is transferred is separated from the drum 62 and then is conveyed to the fixing device 9 along the conveying guide 8. Then, the sheet material P passes through a fixing nip between the heating roller 9*a* and the pressing roller 9*b* which constitute the fixing device 9. At this fixing nip, pressure and heat fixing is effected, so that the toner image is fixed on the sheet material P. The sheet material P on which the toner image is fixed is conveyed to the discharging roller pair 10 and then is discharged onto the discharge tray 11.

On the other hand, as shown in FIG. 3, the drum 62 after the transfer is, after a residual toner on the outer peripheral surface of the drum 62 is removed by a cleaning blade 77, used again in the image forming process. The residual toner removed from the drum 62 is stored in a residual toner chamber 71*b* of a cleaning unit 60.

(Mounting and Demounting Constitution of Cartridge)

Figure 4:
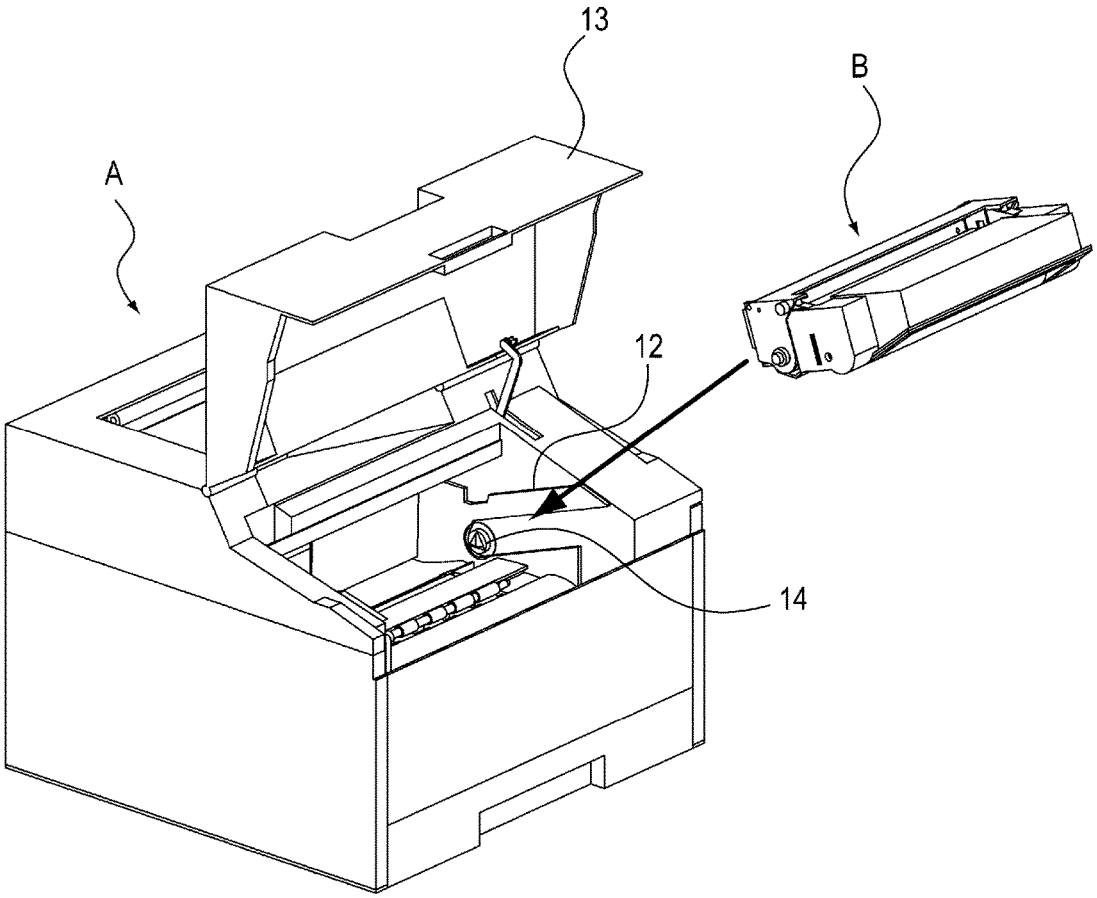
FIG. 4 is a perspective view showing a state in which the cartridge is being mounted into the image forming apparatus in Embodiment 1.

Next, mounting and demounting of the cartridge B relative to the apparatus main assembly A will be described using FIG. 4. FIG. 4 is a perspective view of the apparatus main assembly in which an openable door 13 is opened for mounting and demounting the cartridge B, and of the cartridge B.

The apparatus main assembly is provided with the openable door 13 so as to be rotatable. When the openable door 13 is opened, a guide rail 12 is in sight, and the cartridge B is mounted into the apparatus main assembly A along the guide rail 12. Then, a driving shaft 14 driven by a motor (not shown) of the apparatus main assembly A engages with a driving force receiving portion provided on the cartridge B. As a result, the drum 62 connecting with the driving force receiving portion receives the driving force from the apparatus main assembly A, and thus is rotated.

(General Structure of Process Cartridge)

Figure 5:
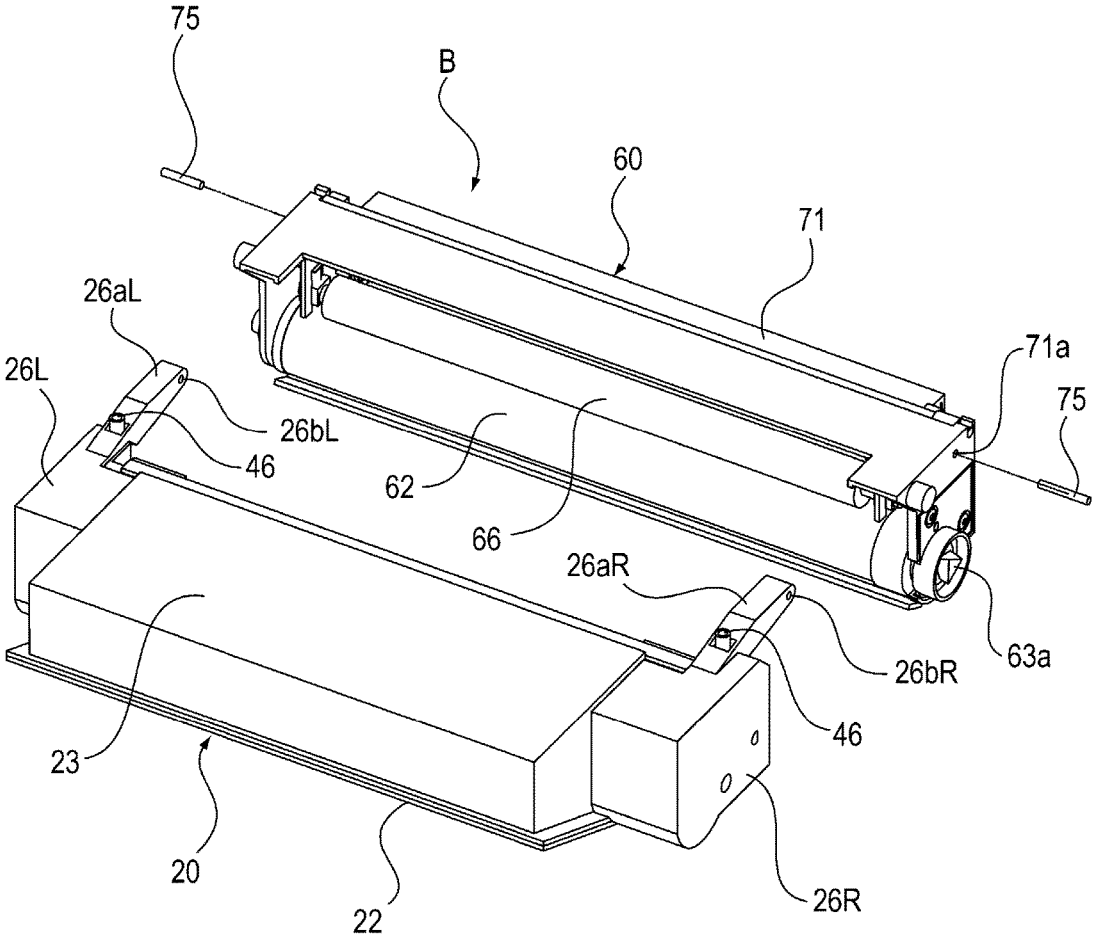
FIG. 5 is a perspective view of the cartridge in Embodiment 1.

Next, with reference to FIGS. 3 and 5, a general structure of the cartridge B will be described. FIG. 5 is a perspective view for illustrating a structure of the cartridge B.

The cartridge B is constituted by combining the cleaning unit 60 and the developing device unit 20. The cleaning unit 60 is constituted by a cleaning frame 71, the drum (first bearing member) 62, the charging roller 66, the cleaning blade 77 and the like. On the other hand, the developing device unit 20 is constituted by, a cap member 22, a toner accommodating frame 23, first and second side members 26L and 26R, a developing blade 42, the developing roller 32, the magnet roller 34, a toner stirring sheet 44, the toner T, an urging member 46, and the like. These cleaning unit 60 and developing device unit 20 are rotationally movably connected with each other by a connecting member 75, so that the cartridge B is constituted.

Specifically, at free end portions of arm portions 26aL, 26aR formed on the first and second side members 26L, 26R provided at both end portions of the developing device unit 20 with respect to a longitudinal direction of the developing device unit 20, rotational movement holes 26bL, 26bR in parallel with the developing roller 32 are provided, respectively. Further, at each of longitudinal end portions of the cleaning frame 71, an engaging hole 71*a* for permitting engagement therein of the connecting member 75 is formed.

Then, the arm portions 26aL and 26aR are aligned with predetermined positions of the cleaning frame 71, and then the connecting members 75 are inserted into the rotational movement holes 26bL and 26bR and the engaging holes 71*a*. As a result, the cleaning unit 60 and the developing device unit 20 are connected with each other rotatably about the connecting members 75.

At this time, urging members 46 mounted at base portions of the arm portions 26aL and 26aR abut against the cleaning frame 71, so that the urging members 46 urge the developing device unit 20 toward the cleaning unit 60 with the connecting members 75 as the rotation centers. As a result, the developing roller 32 is pressed toward the drum 62 with reliability.

(Developing Device Unit)

Next, the developing device unit in the present invention will be described. First, using FIG. 6, a constitution of a rotatable member unit 54 used in the present invention will be described.

Figure 6:
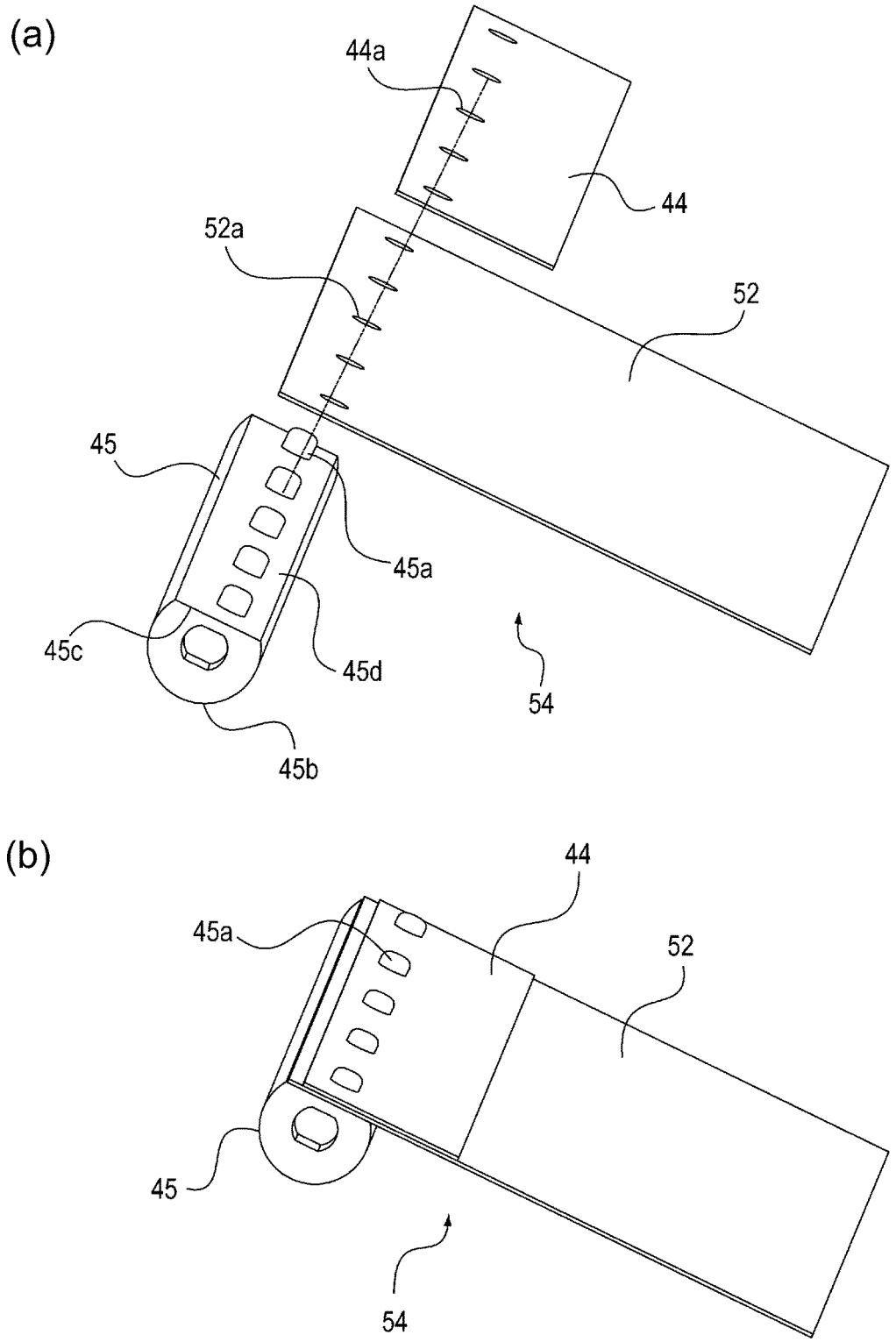
In FIG. 6, (a) and (b) are perspective views each showing a stirring member in Embodiment 1.

As shown in 8*a*) of FIG. 6, the rotatable member unit 54 is constituted by a sealing member (toner sealing member) 52, the toner stirring sheet 44 and the rotatable member 45. The sealing member 52 is constituted by a material compatible with a material of the toner accommodating frame 23 or by a material including an adhesive layer. In this embodiment, as the material of the sealing member 52, a material, such as PET, PC or PPS, which has flexibility and which includes the adhesive layer capable of being melted by heat and bonded to a frame (container) 23. The sealing member 52 is provided with a plurality of holes 52*a* arranged in a longitudinal direction, of the rotatable member 45, which is an axial direction of the rotatable member 45.

The toner storing sheet 44 as a stirring member is formed with a sheet-shaped material, such as PET, PC or PPS, having flexibility, and is provided with a plurality of holes 44*a* arranged in the longitudinal direction of the rotatable member 45 similarly as in the case of the sealing member 52.

The rotatable member 45 used in this embodiment is constituted by an arcuate portion 45*b* and a rectilinear portion 45*c* in cross section as seen in the longitudinal direction of the rotatable member 45, and a mounting surface 45*d* corresponding to the rectilinear portion 45*c* of the cross section is provided with a plurality of projections 45*a*, arranged in the longitudinal direction, for supporting the above-described pluralities of the holes 53*a* and the holes 44*a*.

The sealing member 52 and the toner stirring sheet 44 are, as shown in (a) of FIG. 6, supported at the holes 52*a* and the holes 44*a* by the projections 45*a* of the rotatable member 45, and thereafter are fixed to the rotatable member 45 by thermal caulking as shown in (b) of FIG. 6. In this embodiment, the fixing of the sealing member 52 and the toner stirring sheet 44 is performed by the thermal caulking as described above, the fixing is not limited thereto but may also be performed by another means such as a double-side tape or snap fitting. Further, as regards the mounting surface for the sealing member 52 and the toner stirring sheet 44, the sealing member 52 and the toner stirring sheet 44 may be mounted on the same mounting surface 45*d* as in this embodiment or may also be mounted on different surfaces of the rotatable member 45.

(Mounting Method of Rotatable Member Unit 54 and Sealing Member 52)

Next, a mounting method of the rotatable member unit 54 and the sealing member 52 to the toner accommodating frame 23 will be described using FIG. 7. In (a) of FIG. 7, an arrow X direction is the longitudinal direction which is the axial direction of the rotatable member 45, and an arrow Z direction is a widthwise (short) direction perpendicular to the axial direction.

Figure 7:
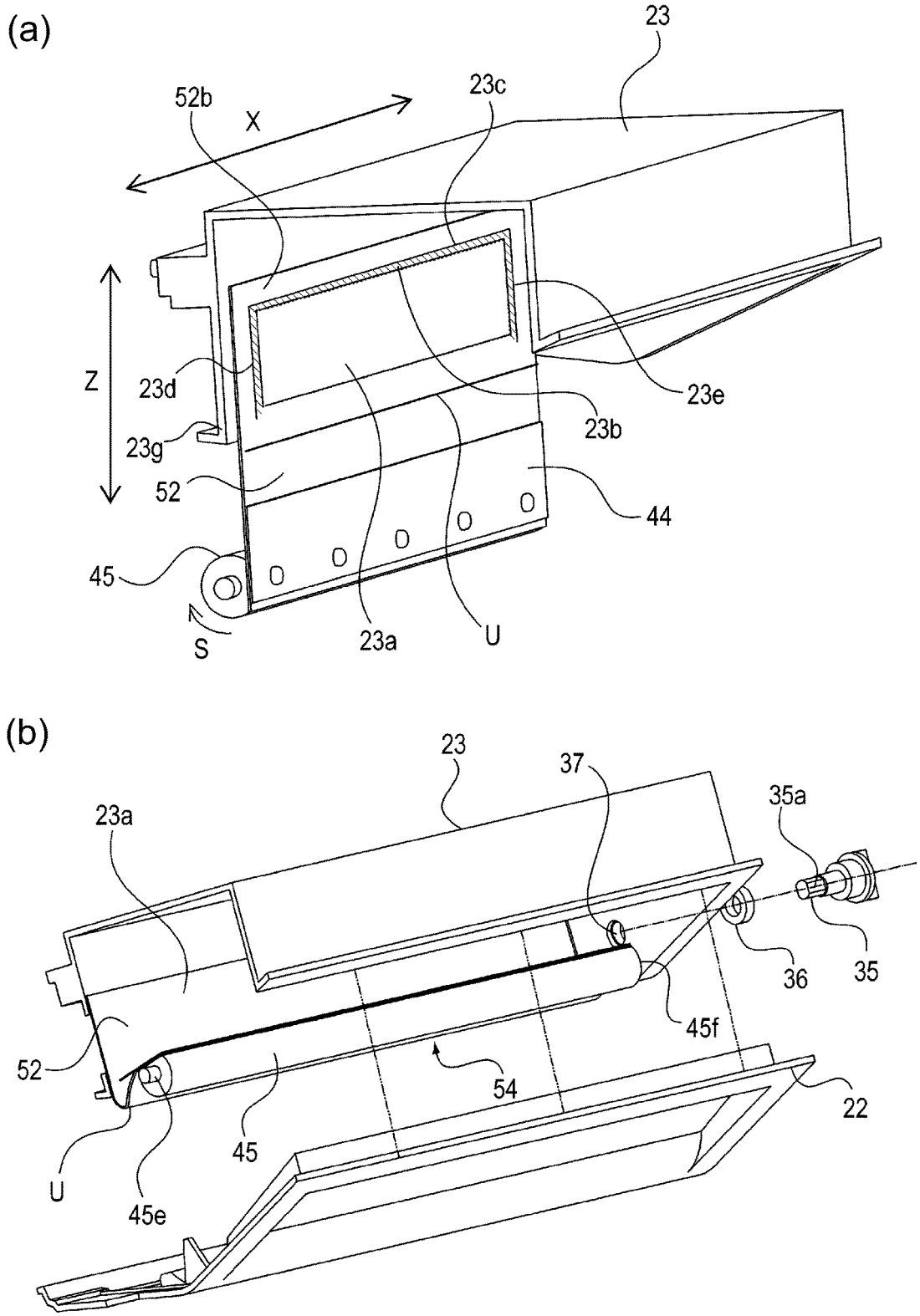
In FIG. 7, (a) and (b) are perspective views for illustrating assembling of a sealing member in Embodiment 1.

As shown in (a) of FIG. 7, one end portion 52*b* of the sealing member 52 fixed to the rotatable member 45 with respect to the widthwise direction is fixed by the thermal welding or the like or a fixing portion 23*b* (hatched portion in (a) of FIG. 7) provided at a periphery of a toner supply opening 23*a* of the toner accommodating frame 23. The fixing portion 23*a* is constituted by a first fixing portion 23*c* extending along the longitudinal direction of the toner supply opening 23*a* and by second and third fixing portions 23*d* and 23*e* each extending along the widthwise direction of the toner supply opening 23*a*. The second fixing portion 23*d* is positioned on a non-driving side opposite with respect to the longitudinal direction, from a side where the driving shaft 14 is provided in the apparatus main assembly A. The third fixing portion 23*e* is positioned on a driving side which is the same side, with respect to the longitudinal direction, as the side where the driving shaft 14 is provided in the apparatus main assembly A. Further, the sealing member 52 is provided with a folded-back portion U where the sealing member 52 is folded back.

As shown in (b) of FIG. 7, the toner supply opening 23*a* is sealed (covered) with the sealing member 52 at the fixing portion 23*b*. Thereafter, the rotatable member unit 54 is supported by a shaft portion 35*a* of a stirring gear member 35 through a hole 37 provided in the toner accommodating frame 23 by inserting a driving-side end portion 45*f* of the rotatable member 45 into the hole 37. On the other hand, a shaft portion 45*e* as a non-driving-side end portion of the rotatable member 45 is rotatably supported by an unshown hole provided in the toner accommodating frame 23.

On the driving side, a seal member 36 is provided and constituted so as to prevent toner leakage through the hole 37 of the toner accommodating frame 23. The rotatable member unit 54 is supported by the toner accommodating frame 23 and thereafter, the cap member 22 is fixed to the toner accommodating frame 23 by welding or the like.

(Sandwiching Portion M)

Figure 1:
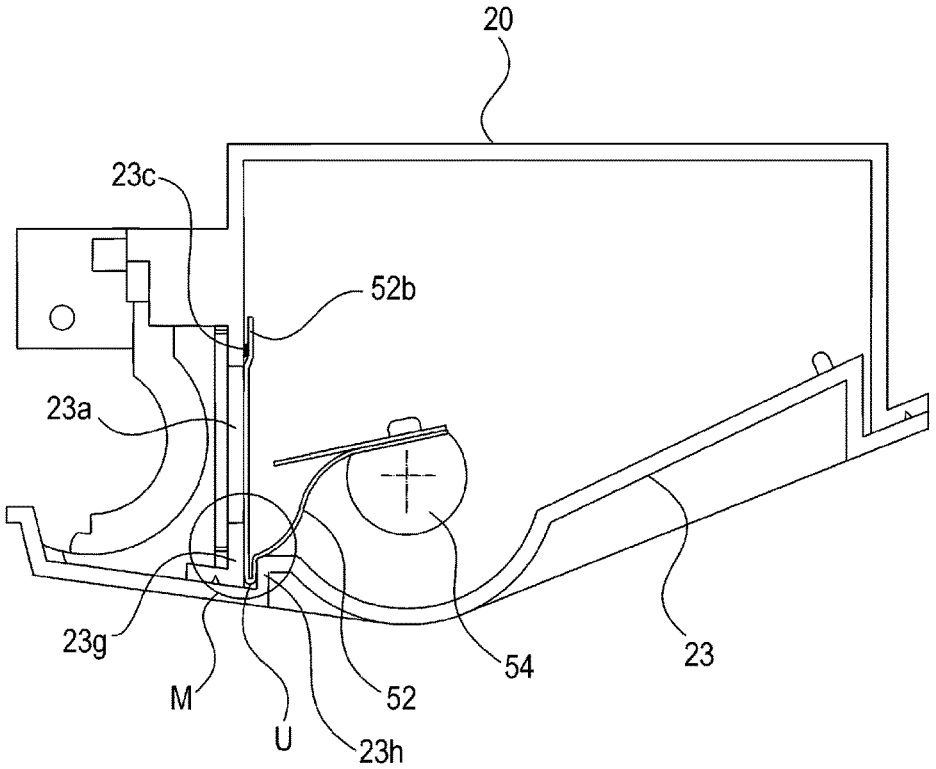
In FIG. 1, (a) and (b) are sectional views of a developing device unit according to Embodiment 1.
Figure 1:
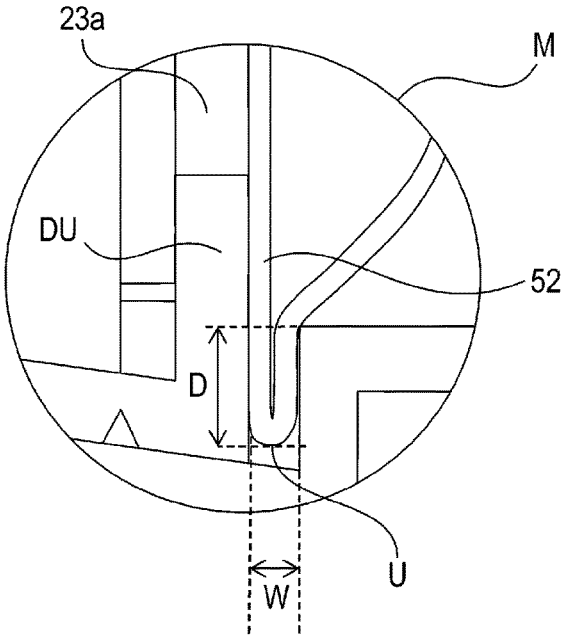

In FIG. 1, (a) and (b) are sectional views of the developing device unit 20 in this embodiment, in which (a) is the sectional view of an entirety of the developing device unit 20 and (b) is an enlarged view showing the folded-back portion U of the sealing member 52 and a sandwiching portion M in the developing device unit. Cross sections shown in (a) and (b) of FIG. 1 are planes perpendicular to the toner supply opening 23*a*.

In this embodiment, as shown in (a) of FIG. 1, one end portion 52*b* of the sealing member 52 is welded to the fixing portion 23*c* which is a portion on an upper end of the toner supply opening 23*a*. Further, at the sandwiching portion M which is a portion under a lower end of the toner supply opening 23*a*, the sealing member is sandwiched in a state in which the sealing member is folded back with the folded-back portion U as a bottom thereof. The sandwiching portion M is constituted by a wall 23*g*, provided with the toner supply opening 23*a*, constituting the toner accommodating frame 23 and a part 23*h*, opposing the wall 23*g*, of the toner accommodating frame 23. A portion, of the sealing member 52, sandwiched by the sandwiching portion M is not welded (i.e., nonwelded) in the sandwiching portion M when the sealing member 52 is seen on a plane perpendicular to the toner supply opening 23*a*. Further, when the folded-back portion U of the sealing member 52 is sandwiched by the sandwiching portion M, a depth of the sealing member 52 (the folded-back portion U) is D, a width of the sealing member M is W, and a thickness of the sealing member 52 is L ((b) of FIG. 1). As a condition of the width W at this time, when the width W is narrowed to the extent that the sealing member 52 is compressed (deformed), the sealing member 52 is not disconnected from the sandwiching portion M. For that reason, as a condition that the folded-back sealing member 52 is not compressed, there is a need to satisfy $2L>W$. Further, in the case where the width W is large, it is natural that the sealing member 52 is not in a state in which the folded-back portion U is sandwiched in the sandwiching portion M, and therefore as a result of investigation, it was found that $W<5L$ is desirable. From the above result, as the condition of the width W, it is desirable that $2L<W<5L$ is satisfied. In this embodiment, the depth D was 10 mm, the width W was 400 μm and the thickness L was 100 μm. By sandwiching the sealing member 52 in the sandwiching portion M in a state in which the sealing member 52 is folded back in the sandwiching portion M with the folded-back portion U as the bottom thereof, the toner T is prevented from leaking out of the toner accommodating frame 23.

In a conventional constitution, the toner leakage was prevented by bonding the sealing member to the frame by welding, but in this case, a load of a torque when the sealing member is peeled off from the frame is large. In order to reduce the load, the sealing member is sandwiched, so that not only the load of the torque is reduced but also a degree of the toner leakage is reduced. That is, the sandwiching of the sealing member (folded-back portion U) is as if a temporally sealing.

For that reason, in this embodiment, the sealing member and the frame are not welded to each other in a region of the depth D of the sandwiching portion M in (b) of FIG. 1, and in addition, the sealing member is not welded to also a frame portion DU which is on the depth D region and under the opening. That is, a lower portion, of the sealing member, under the opening (on an upstream side with respect to an unsealing direction) is subjected to the temporary sealing for the sandwiching without being weld.

However, the present invention is not limited thereto, but the frame portion DU under the opening and the sealing member may also be welded to each other. In this case, compared with conventional welding, a torque load in the above welding is small. That is, the temporary sealing and the welding are used in combination.

(Unsealing Method of Sealing Member 52)

An unsealing operation of the sealing member 52 will be described using (a) to (d) of FIG. 8. When the cartridge B is mounted in the apparatus main assembly A and the openable door 13 of the apparatus main assembly A is closed, rotational drive of the apparatus main assembly A is started. With the rotational drive of the apparatus main assembly A, the drum 62 of the cartridge B receives a driving force from the apparatus main assembly A and is rotated. When the drum 62 is rotationally driven, the rotatable member 45 is started to be rotated in an arrow S direction in (a) of FIG. 8 by a driving gear (not shown) provided in the cartridge B.

Figure 8:
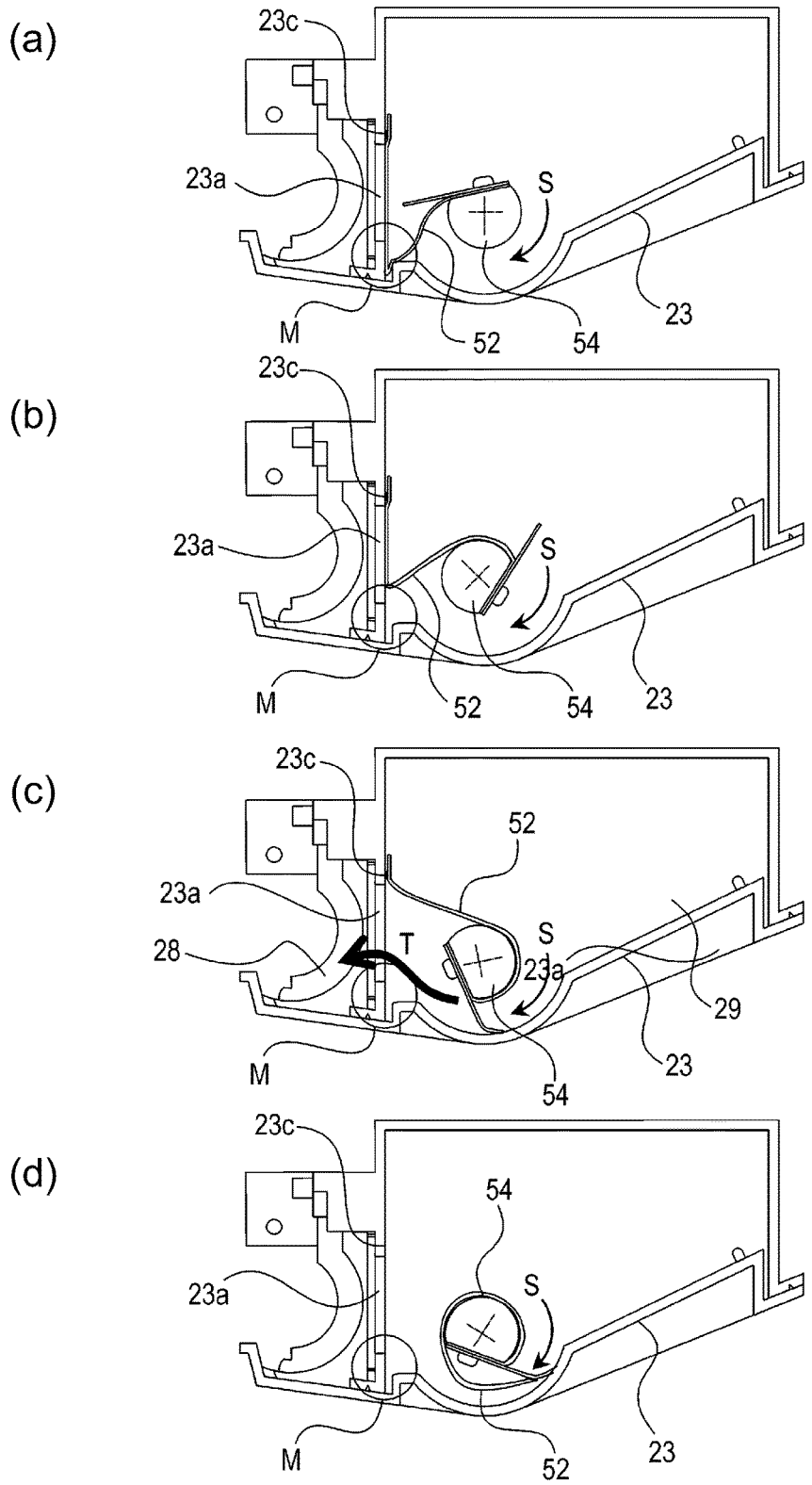
In FIG. 8, (a) to (d) are sectional views for illustrating an unsealing operation of the sealing member in Embodiment 1.

With rotation of the rotatable member 45, the sealing member 52 mounted to the rotatable member unit 54 is subjected to tension and receives a force in a direction of being spaced from the toner supply opening 23*a*, and therefore the folded-back portion U of the sealing member 52 is disconnected (eliminated) from the sandwiching portion M ((b) of FIG. 8). As a result, the sealing member 52 is peeled off from the toner supply opening 23*a*, and therefore the toner T is sent from the toner accommodating frame 23 in a direction toward a developing sleeve by the rotatable member unit 54 ((c) of FIG. 8). Thereafter, with further rotation of the rotatable member unit 54, the sealing member 52 is peeled off from the fixing portion 23*c* above the toner supply opening 23*a*. The toner stirring sheet 44 is mounted at one end portion thereof together with the sealing member 52 on the rotatable member 45, and therefore by the rotation of the rotatable member 45, the toner stirring sheet 44 is rotated simultaneously with the sealing member 52. By this toner stirring member rotated simultaneously with the sealing member 52, the toner T in the toner chamber 29 is fed while being stirred, and is sent toward the toner supplying chamber 28 through the toner supply opening 23*a*. Then, finally, the toner T is coated on the developing sleeve, and the image forming apparatus is in a printable state, so that the drive of the apparatus main assembly A stops ((d) of FIG. 8).

(Toner Filling Port and Filling Method)

Figure 9:
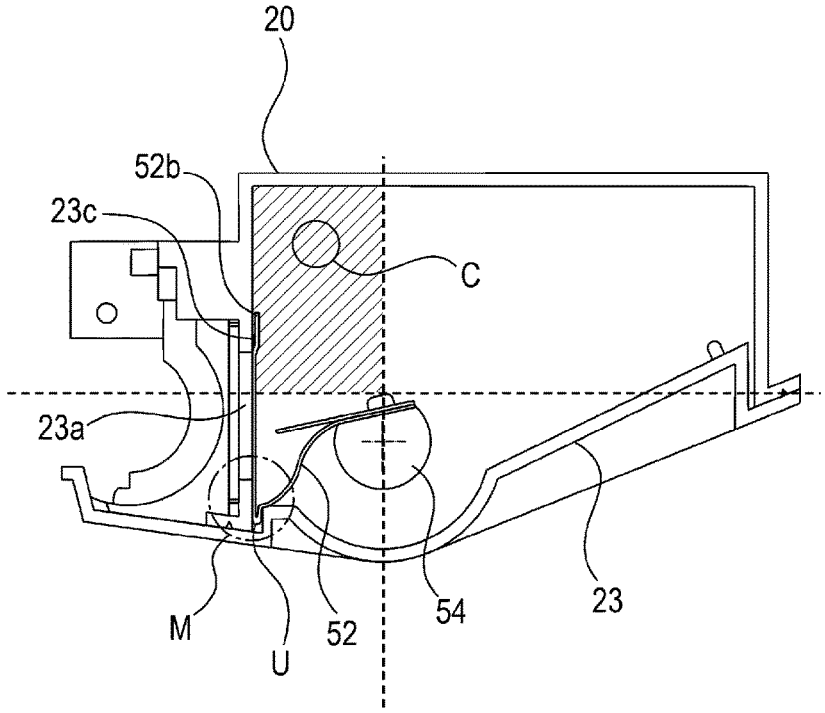
In FIG. 9, (a) and (b) are illustrations each showing a toner filling port in the developing device unit in Embodiment 1.
Figure 9:
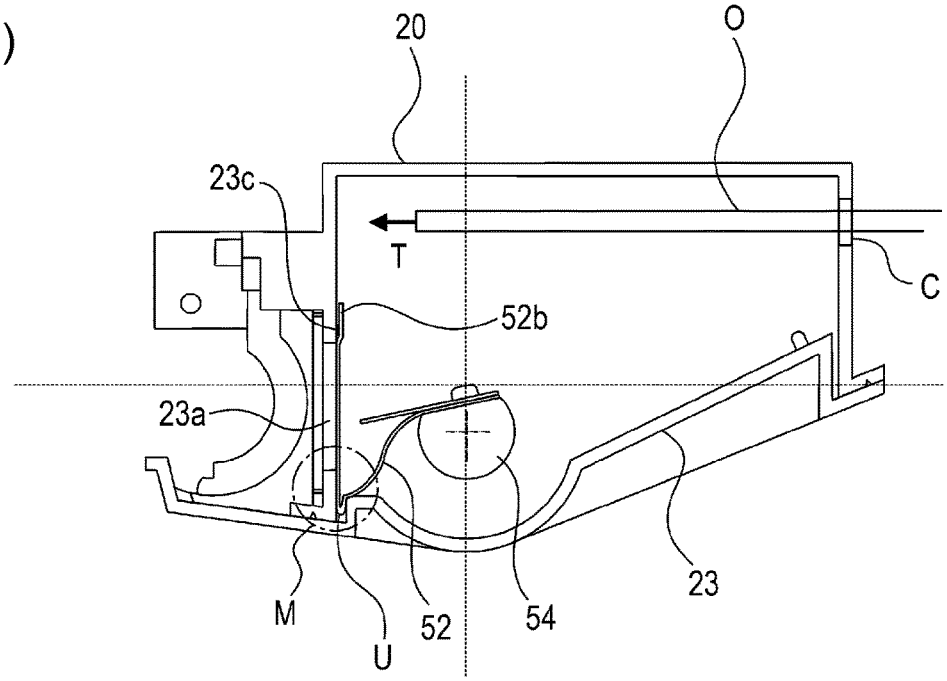

At the sandwiching portion M, different from the welding, the sealing member 52 is not completely fixed, and therefore the sealing member 52 is required to be prevented from disconnecting from the sandwiching portion M particularly during filling of the toner. For that reason, in the case where the toner is filled, there is a need that the toner T is sent to above the sealing member 52 and using a self-weight of the toner T, the sealing member 52 is not readily disconnected from the sealing member M. For that reason, as a filling port C through which the toner T is filled into the developing device unit 20, the filling port C may desirably be a hatched region shown in (a) of FIG. 9. Specifically, as the filling port C, it is desirable that the filling port C is provided in a container wall of the toner accommodating frame 23 on not only a side closer to the toner supply opening 23*a* than an axial center of the rotatable member unit 54 is but also a side above a rotation locus of a rotation shaft of the rotatable member unit 54. However, as shown in 8*b*) of FIG. 9, in the case where a position where the toner T is filled can be arbitrarily designated using a nozzle O or the like, the position of the filling port C is not limited if a filling condition of the toner T for causing the sealing member 52 to be not readily disconnected from the sandwiching portion M is satisfied. Further, also after the filling of the toner T, movement of the toner T is prevented to the possible extent by an attitude of the cartridge B, so that it becomes possible to prevent the sealing member 52 from disconnecting from the sandwiching portion M by the movement of the sealing member 52. For that reason, also as regards a toner filling amount, the toner may preferably be filled without providing a space in the toner accommodating frame to the possible extent.

(Verification Experiment)

How a torque (N.m) of the driving shaft 14 during unsealing of the sealing member 52 in this embodiment changes will be verified. As Comparison Example, the case where the sealing member 52 is welded at the fixing portions 23*c*, 23*d*, 23*e*, 23*f* surrounding the toner supply opening 23*a* as shown in (a) of FIG. 10 is used.

Figure 10:
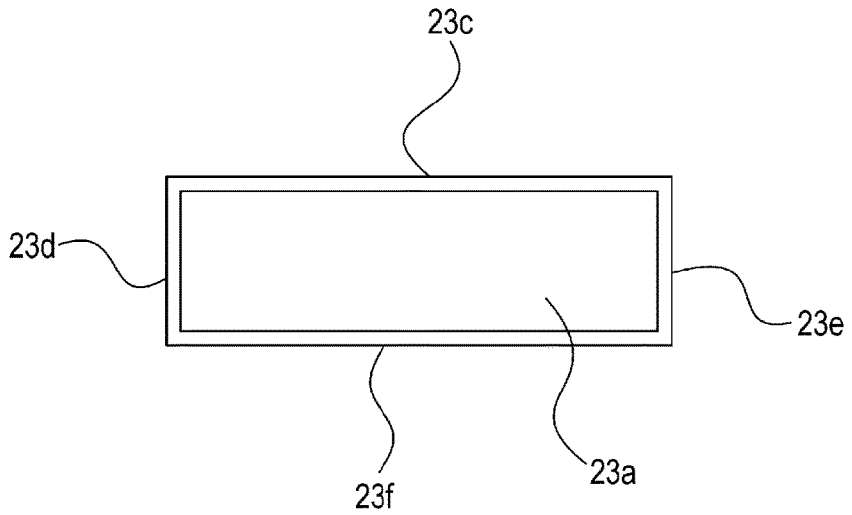
In FIG. 10, (a) is an illustration of a toner supply opening in Embodiment 1, and (b) is a graph showing a result of comparison and investigation of a torque during unsealing of a sealing member in Embodiment 1 and Comparison Example.
Figure 10:
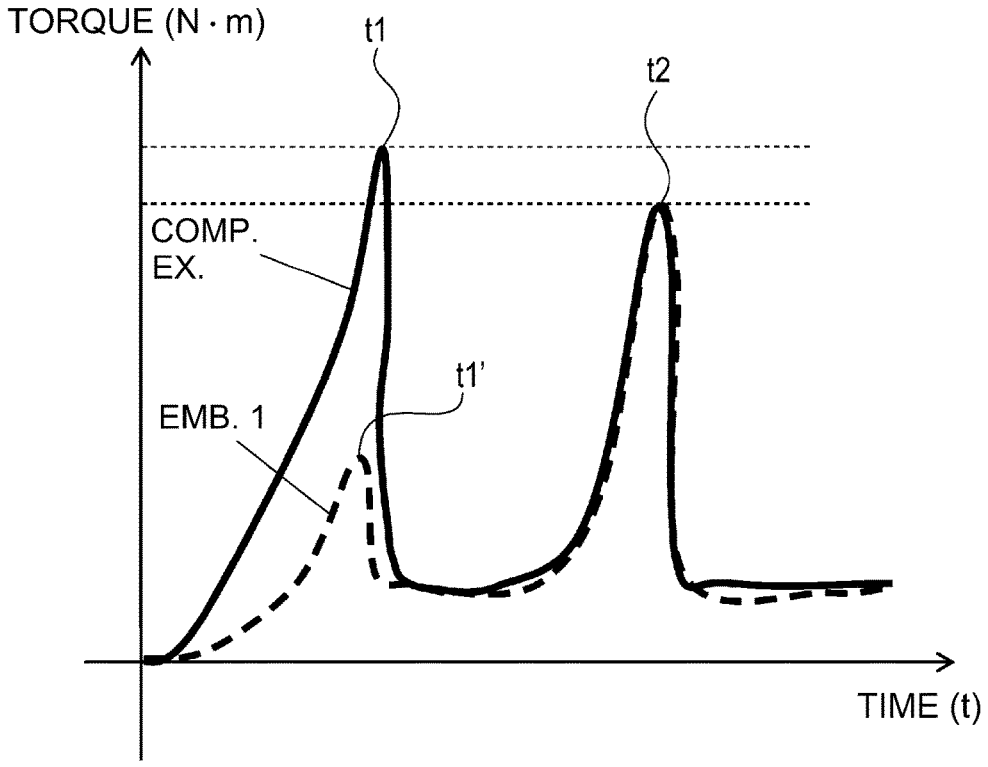

In FIG. 10, (b) is a graph in which a rotation start time of the driving shaft 14 of the apparatus main assembly A is taken as an origin on an abscissa and a magnitude of a torque is represented by an ordinate and in which progression of the torque from the rotational drive of the driving shaft 14. In the graph of (b) of FIG. 10, a solid line represents Comparison Example and shows the torque during unsealing in the case where the sealing member 52 is welded to an entirety of a periphery of the toner supply opening 23*a*. Further, in the graph of (b) of FIG. 10, a broken line represents Embodiment 1 and shows the torque during unsealing in the constitution in which the sealing member 52 is sandwiched in the sandwiching portion M.

Two peaks t1 and t2 where the torque in Comparison Example in (b) of FIG. 10 increases will be described. The peak t1 is a torque peak in the case where the welding at the fixing portion 23*f* is eliminated, and the peak t2 is a torque peak in the case where the welding at the fixing portion 23*c* is eliminated. When these torque peaks are compared with each other, it is understood that in the same constitution, a maximum torque at t1 is larger than a maximum torque at t2. This is because these torques are those immediately after the start of the drive of the driving shaft 14 and therefore the toner T in the toner accommodating frame is not loosened and thus the torque of the rotatable member unit 54 rotating in the toner T is large. On the other hand, at the peak t2, the toner T is loosened by the rotatable member and therefore compared with the peak t1, the sealing member 52 can be peeled off from the fixing portion 23*c* with a small torque. Similarly, an increased torque peak t1' in Embodiment 2 (this embodiment) in (b) of FIG. 10 shows a torque in the case where the sealing member 52 sandwiched in the sandwiching portion M is disconnected from the sandwiching portion M, and it is understood that compared with t1 in Comparison Example in which the sealing member is welded, the torque becomes small. Further, as regards the peak t2, the sealing member is welded in both of Comparison Example and Embodiment 1, and therefore it is understood that the torque is the same.

From the above, in the constitution in this embodiment, it becomes possible to suppress a torque peak value and thus to suppress a necessary torque as a whole.

Further, comparison and investigation regarding toner leakage from the toner accommodating frame was conducted. As the comparison and investigation regarding the toner leakage, a drop test of the cartridge B was conducted. The drop test is conducted in a packaged state in which the cartridge B is placed in an unused case. Assuming that the cartridge B is transported, the cartridge B is dropped from a height of 100 cm while being in the packaged state, and then whether or not the toner leaks out of the cartridge B is checked. As an object to be compared with that in this embodiment, the cartridge B in the case where the sealing member 52 is welded to the entirety of the periphery of the toner supply opening 23*a* ((a) of FIG. 10) is used similarly as in the case of the measurement of the torque.

In the above-described comparison and investigation, in both of the constitutions in Embodiment 1 and Comparison Example, the toner leakage did not generate, and therefore it was confirmed that the toner T was able to be sealed in the toner accommodating frame 23 with no problem.

From the comparison and investigation described above, in the constitution in this embodiment, it becomes possible to suppress the torque during unsealing of the sealing member 52 while preventing the toner leakage from the cartridge B.

[Embodiment 2]

Embodiment 2 is characterized in that in addition to the constitution in Embodiment 1 in which the folded-back portion of the sealing member 52 is sandwiched, sealing is made using a restoring force of the folded-back portion so that the toner leakage can be further prevented.

In Embodiment 2, an apparatus main assembly A and an image forming process are the same as those in Embodiment 1, and therefore description of a sandwiching portion M of a developing device unit 20 will be made.

(Sandwiching Portion M)

Figure 11:
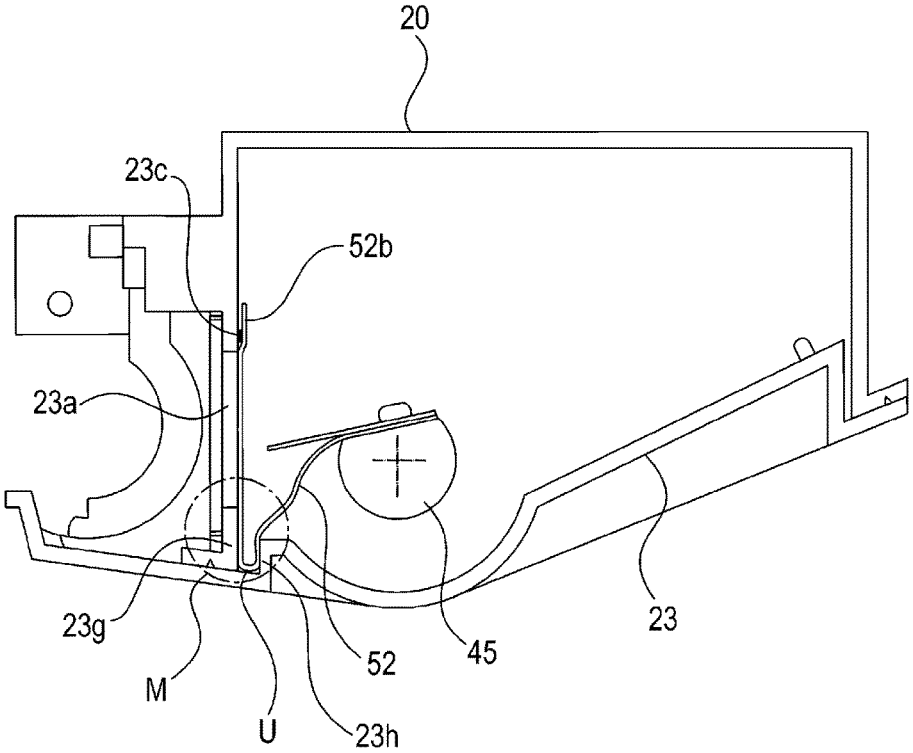
In FIG. 11, (a) and (b) are sectional views of a developing device unit according to Embodiment 2.
Figure 11:
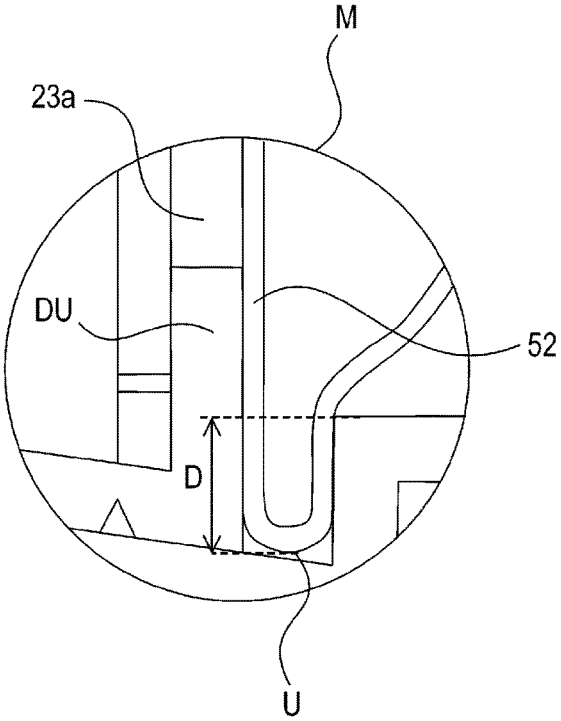

In FIG. 11, (a) and (b) are sectional views of the developing device unit 20 in this embodiment, in which (a) is the sectional view of an entirety of the developing device unit 20 and (b) is an enlarged view showing the folded-back portion U of the sealing member 52 and a sandwiching portion M in the developing device unit. Cross sections shown in (a) and (b) of FIG. 11 are planes perpendicular to the toner supply opening 23*a*.

In this embodiment, as shown in (a) of FIG. 11, one end portion 52*b* of the sealing member 52 is welded to the fixing portion 23*c* which is a portion on an upper end of the toner supply opening 23*a* and welded to the side fixing portions 23*d*, 23*e* ((a) of FIG. 10). Further, at the sandwiching portion M which is a portion under a lower end of the toner supply opening 23*a*, the sealing member is sandwiched the toner accommodating frame 23 in a state in which the sealing member is folded back with the folded-back portion U as an inflection point thereof. The sandwiching portion M is constituted by a wall 23*g*, provided with the toner supply opening 23*a*, constituting the toner accommodating frame 23 and a part 23*h*, opposing the wall 23*g*, of the toner accommodating frame 23. However, depending on a magnitude of the toner supply opening 23*a*, the sealing member 52 is not particularly required to be welded at the fixing portions 23*d*, 23*e*. Further, a portion, of the sealing member 52, sandwiched by the sandwiching portion M is not welded (i.e., nonwelded) in the sandwiching portion M when the sealing member 52 is seen on a plane perpendicular to the toner supply opening 23*a*.

In this embodiment, different from Embodiment 1, the sealing member 52 is not in the state in which the sealing member 52 is (sharply) folded back with the folded-back portion U as the bottom thereof, but is (loosely) folded back so as to have the inflection point at the folded-back portion U. For that reason, the sealing member 52 is sandwiched in the sandwiching portion M of the toner accommodating frame 23 by using a restoring force F of the sealing member 52. Herein, the restoring force F refers to a force F (indicated by arrows in (a) of FIG. 12) by which the sealing member 52 is restored to an original state in the case where the sealing member 52 is flexed (bent) using a flexible material as shown in (a) of FIG. 12. In this case, a condition in which the restoring force F of the sealing member 52 is obtained and thus the toner T can be sealed in the toner accommodating frame 23 will be described using (b) of FIG. 12.

A depth D in which the sealing member 52 is sandwiched in the sandwiching portion M may only be required to be not less than a radius R of an arcuate portion, i.e., D>R. This is because, in the case of D≤R, the folded-back portion of the sealing member 52 is shallowly sandwiched in the sandwiching portion M and is likely to be restored to the original state by the restoring force F and therefore is liable to disconnect from the sandwiching portion M when is shallowly sandwiched.

Further, as regards a width W of the sandwiching portion M, 2R>W may only be required in order to obtain the restoring force F in the case where the sealing member 52 is folded back. This is also a condition such that similarly as in the case of the sandwiching depth D, the sealing member 52 is shallowly sandwiched in the sandwiching portion M and is prevented from easily disconnecting from the sandwiching portion M.

Further, a material of the sealing member 52 may only be required to be flexible, and a thickness thereof is needed to be not less than a thickness in which the restoring force generates and not more than a thickness in which the sealing member 52 can be folded back. Values of these thicknesses are determined depending on the material of the sealing member 52.

From the above, in this embodiment, the depth D of the sandwiching portion M is 10 mm, and the width W of the sandwiching portion M is 5 mm. Further, the thickness L of the sealing member 52 is 100 μm. The material of the sealing member 52 is a flexible material, such as PET, PC or PPS, having an adhesive layer which is melted by heat and thus can be welded to a frame (container). By sandwiching the sealing member 52 in the sandwiching portion M in a folded-back state, the toner T is prevented from leaking out of the toner accommodating frame 23.

(Verification Experiment)

How a torque (N.m) of the driving shaft 14 during unsealing of the sealing member 52 in this embodiment changes will be verified. As Comparison Example, the case where the sealing member 52 is welded at the fixing portions 23*c*, 23*d*, 23*e*, 23*f* surrounding the toner supply opening 23*a* as shown in (a) of FIG. 10 is used.

Figure 13:
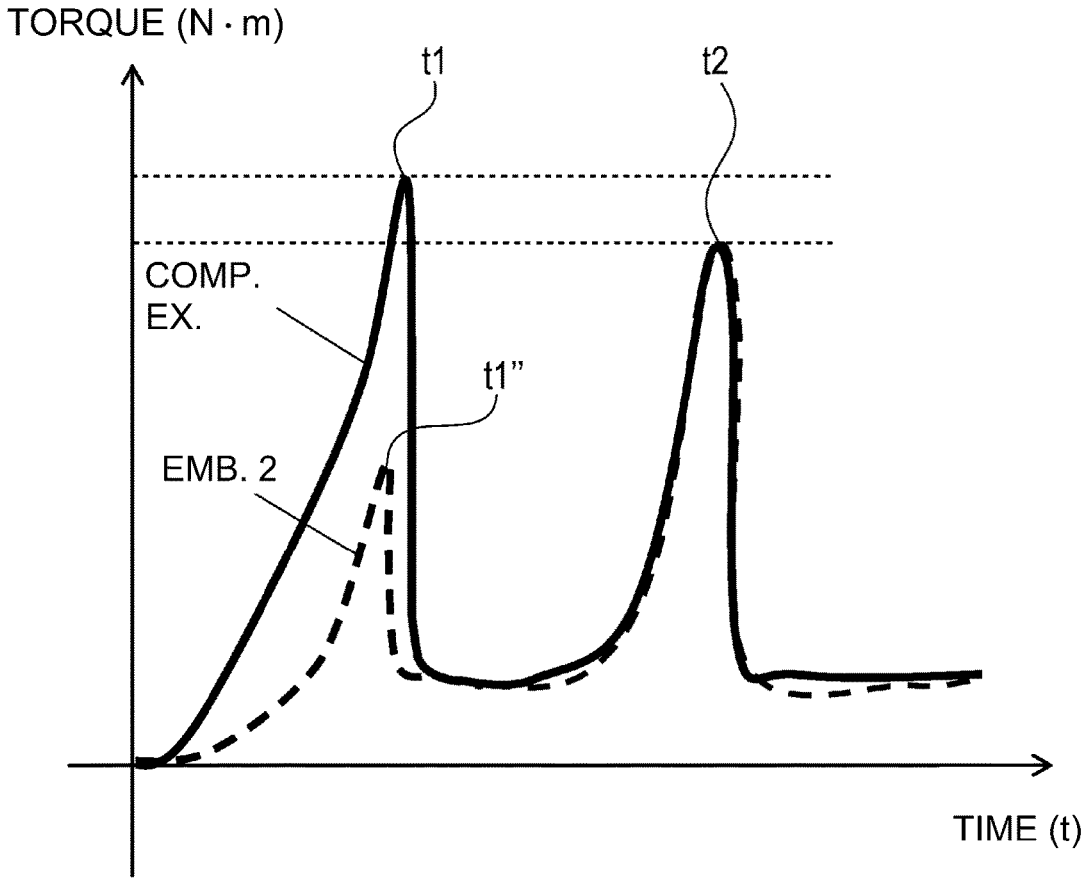
FIG. 13 is a graph showing a result of comparison and investigation of a torque during unsealing of a sealing member in Embodiment 2 and Comparison Example.

FIG. 13 is a graph in which a rotation start time of the driving shaft 14 of the image forming apparatus main assembly A is taken as an origin on an abscissa and a magnitude of a torque is represented by an ordinate and in which progression of the torque from the rotational drive of the driving shaft 14. In the graph of (b) of FIG. 13, a solid line represents Comparison Example and shows the torque during unsealing in the case where the sealing member 52 is welded to an entirety of a periphery of the toner supply opening 23*a* as shown in (a) of FIG. 10. Further, in the graph of FIG. 13, a broken line represents Embodiment 2 and shows the torque during unsealing in the constitution in which the sealing member 52 is sandwiched in the sandwiching portion M.

Of two peaks t1 and t2 where the torque in Comparison Example in FIG. 13 increases, as described in Embodiment 1, the peak t1 is a torque peak in the case where the welding at the fixing portion 23*f* is eliminated, and the peak t2 is a torque peak in the case where the welding at the fixing portion 23*c* is eliminated. Similarly, an increased torque peak t1" in Embodiment 2 (this embodiment) in FIG. 13 shows a torque in the case where the sealing member 52 sandwiched in the sandwiching portion M is disconnected from the sandwiching portion M, and it is understood that compared with t1 in Comparison Example in which the sealing member is welded, the torque becomes small. However, the sealing member 52 is sandwiched using the restoring force F and therefore the torque is larger than the torque in Embodiment 1. Further, as regards the peak t2, the sealing member is welded in both of Comparison Example and Embodiment 1, and therefore it is understood that the torque is the same.

From the above, in the constitution in this embodiment, it becomes possible to suppress a torque peak value and thus to suppress a necessary torque as a whole.

Further, comparison and investigation regarding toner leakage from the toner accommodating frame was conducted. As the comparison and investigation regarding the toner leakage, a drop test of the cartridge B was conducted. The drop test is conducted in a packaged state in which the cartridge B is placed in an unused case. Assuming that the cartridge B is transported, the cartridge B is dropped from a height of 100 cm while being in the packaged state, and then whether or not the toner leaks out of the cartridge B is checked. As an object to be compared with that in this embodiment, the cartridge B in the case where the sealing member 52 is welded to the entirety of the periphery of the toner supply opening 23*a* ((a) of FIG. 10) is used similarly as in the case of the measurement of the torque.

In the above-described comparison and investigation, in both of the constitutions in Embodiment 2 and Comparison Example, the toner leakage did not generate, and therefore it was confirmed that the toner T was able to be sealed in the toner accommodating frame 23 with no problem. Further, compared with Embodiment 1, the sealing is made using the restoring force F in this embodiment, and therefore the sealing can be made more effectively against the toner leakage.

From the comparison and investigation described above, in the constitution in this embodiment, it becomes possible to suppress the torque during unsealing of the sealing member 52 while further preventing the toner leakage from the cartridge B.

[Embodiment 3]

Embodiment 3 is characterized in that in addition to the constitution in Embodiment 2 in which the sealing is made using the restoring force F of the sealing member 52, also at a portion above the opening 23*a*, the folded-back portion is similarly sandwiched and the sealing is made using the restoring force F of the sealing member 52.

In Embodiment 3, an apparatus main assembly A and an image forming process are the same as those in Embodiment 1, and therefore description of a sandwiching portion M of a developing device unit 20 will be made.

(Sandwiching Portion M)

Figure 14:
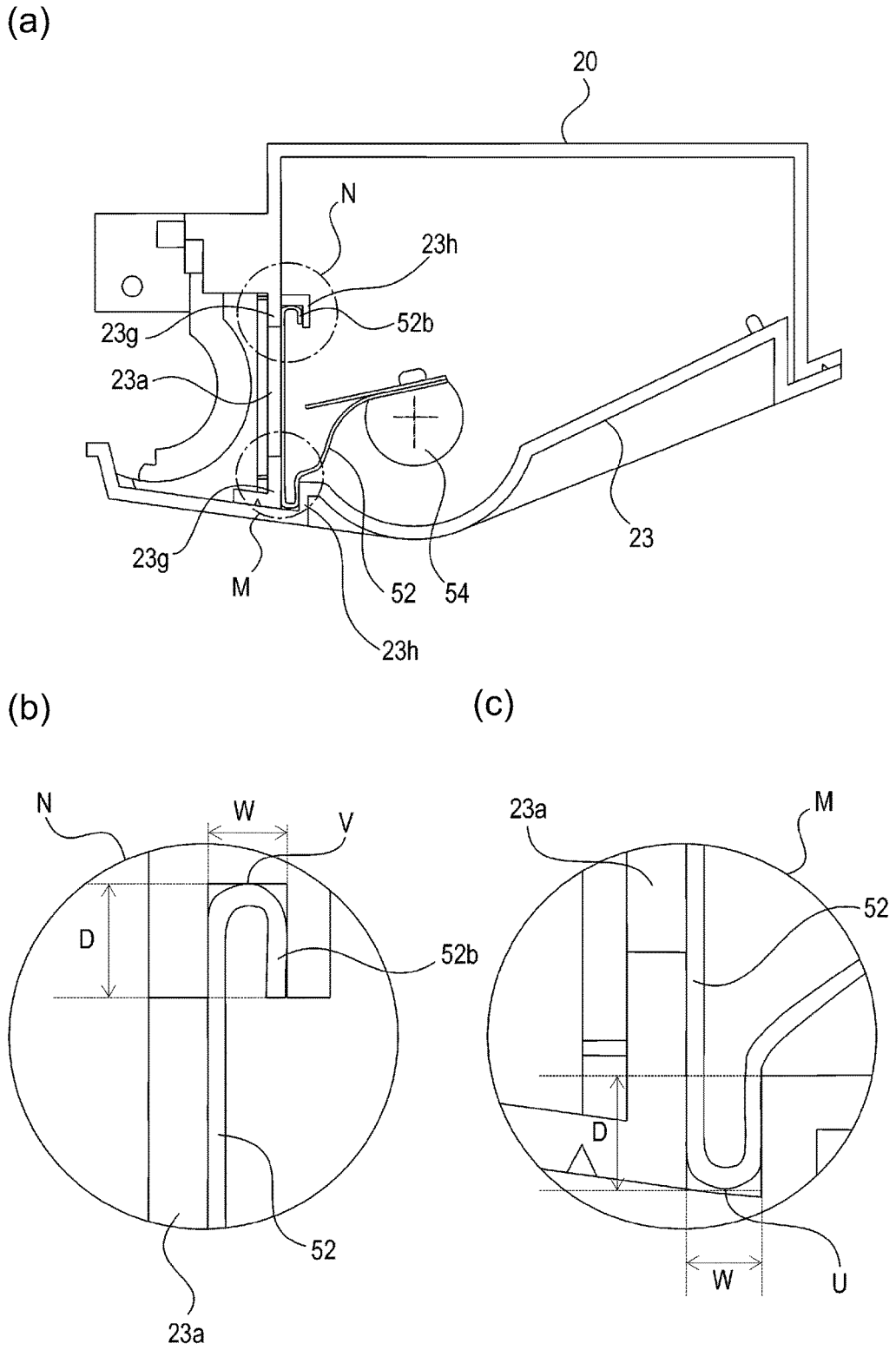
In FIG. 14, (a) to (c) are sectional views of a developing device unit according to Embodiment 3.

In FIG. 14, (a) to (c) are sectional views of the developing device unit 20 in this embodiment, in which (a) is the sectional view of an entirety of the developing device unit 20, and (b) and (c) are enlarged views showing folded-back portions U, V of the sealing member 52 and sandwiching portions M, N in the developing device unit. Cross sections shown in (a) to (c) of FIG. 14 are planes perpendicular to the toner supply opening 23*a*.

In this embodiment, as shown in (a) and (b) of FIG. 14, one end portion 52*b* of the sealing member 52 is sandwiched in the sandwiching portion N which is a portion on an upper end of the toner supply opening 23*a* in a state in which the sealing member 52 is folded back with the folded-back portion V as an inflection point thereof. For this reason, using the restoring force F, the sandwiching portion N sandwiches the sealing member 52. Further, at the sandwiching portion M which is a portion under a lower end of the toner supply opening 23*a*, the sealing member is sandwiched in a state in which the sealing member is folded back with the folded-back portion U as an inflection point thereof. For that reason, similarly as in Embodiment 2, the sealing member 52 is sandwiched in the sandwiching portion M by using the restoring force F. Further, although the side fixing portions 23*d*, 23*e* are not shown in FIG. 14, at the periphery of the toner supply opening 23*a*, the sealing member 52 is welded to the side fixing portions 23*d*, 23*e* sandwiching the toner supply opening 23*a* in this embodiment. However, depending on a magnitude of the toner supply opening 23*a*, a constitution in which the fixing portions 23*d*, 23*e* are not provided, i.e., a constitution in which the sealing member 52 is not welded may also be employed. Further, a portion, of the sealing member 52, sandwiched by the sandwiching portion M is not welded (i.e., nonwelded) in each of the sandwiching portions M, N when the sealing member 52 is seen on a plane perpendicular to the toner supply opening 23*a*. Each of the sandwiching portions M, N is, similarly as in the above-described embodiments, constituted by the wall 23*g*, provided with the toner supply opening 23*a*, constituting the toner accommodating frame 23 and the part 23*h*, opposing the wall 23*g*, of the toner accommodating frame 23.

Figure 12:
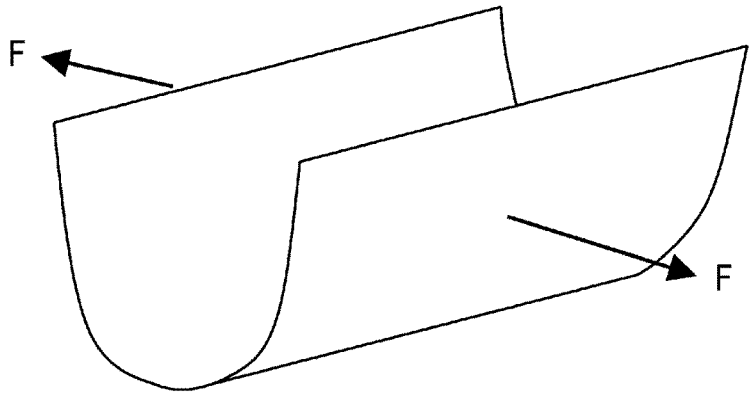
In FIG. 12, (a) and (b) are schematic views for illustrating a sandwiching portion in Embodiment 2.
Figure 12:
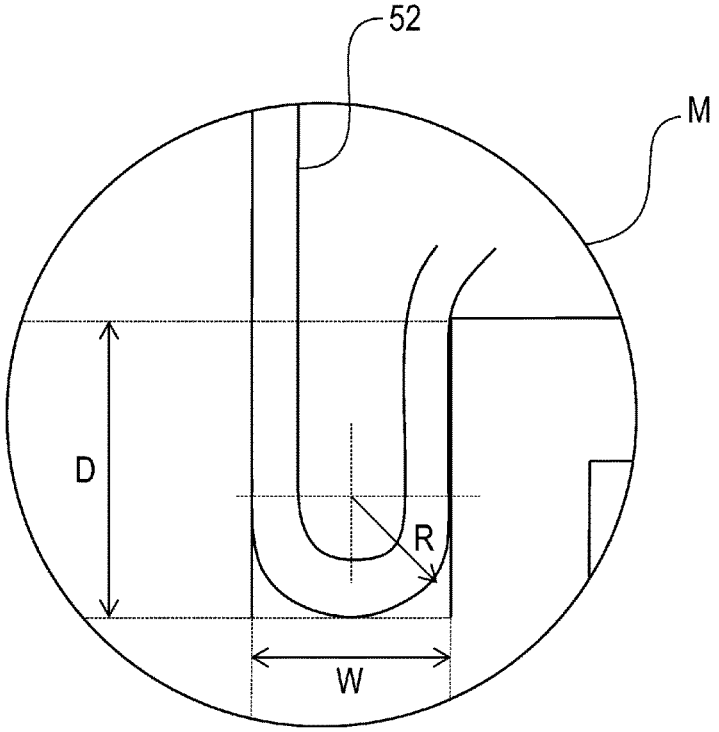

As a condition in which the restoring force F of the sealing member 52 is obtained and thus the toner can be sealed in the toner accommodating frame 23, similarly as in Embodiment 2, as shown in (b) of FIG. 12, a depth D in which the sealing member 52 is sandwiched in the sandwiching portion M may only be required to be not less than a radius R of an arcuate portion, i.e., D>R. This is because, in the case of D≤R, the folded-back portion of the sealing member 52 is shallowly sandwiched in the sandwiching portion M and is likely to be restored to the original state by the restoring force F and therefore is liable to disconnect from the sandwiching portion M when is shallowly sandwiched.

Further, as regards a width W of the sandwiching portion M, 2R>W may only be required in order to obtain the restoring force F in the case where the sealing member 52 is folded back. This is also a condition such that similarly as in the case of the sandwiching depth D, the sealing member 52 is shallowly sandwiched in the sandwiching portion M and is prevented from easily disconnecting from the sandwiching portion M.

Further, a material of the sealing member 52 may only be required to be flexible, and a thickness thereof is needed to be not less than a thickness in which the restoring force generates and not more than a thickness in which the sealing member 52 can be folded back. Values of these thicknesses are determined depending on the material of the sealing member 52.

Similarly, also at the sandwiching portion N, only the direction is changed from the downward direction to the upward direction, and therefore when a condition similar to the condition in the case of the sandwiching portion M is satisfied, the toner T can be sealed in the toner accommodating frame 23 by using the restoring force F.

From the above, in this embodiment, the depth D of each of the sandwiching portions M, N is 10 mm, and the width W of each of the sandwiching portions M, N is 5 mm. Further, the thickness L of the sealing member 52 is 100 μm. The material of the sealing member 52 is a flexible material, such as PET, PC or PPS, having an adhesive layer which is melted by heat and thus can be welded to the container. By sandwiching the sealing member 52 in each of the sandwiching portions M, N in a folded-back state, the toner T is prevented from leaking out of the toner accommodating frame 23.

(Verification Experiment)

How a torque (N.m) of the driving shaft 14 during unsealing of the sealing member 52 in this embodiment changes will be verified. As Comparison Example, the case where the sealing member 52 is welded at the fixing portions 23*c*, 23*d*, 23*e*, 23*f* surrounding the toner supply opening 23*a* as shown in (a) of FIG. 10 is used.

Figure 15:
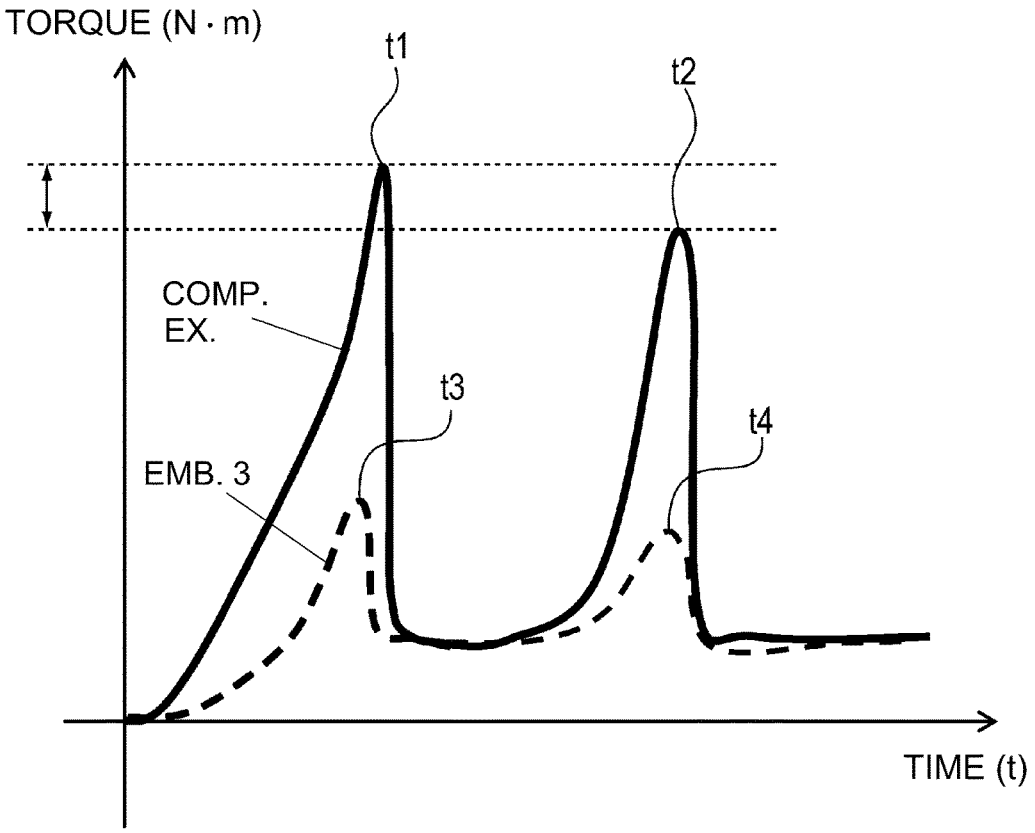
FIG. 15 is a graph showing a result of comparison and investigation of a torque during unsealing of a sealing member in Embodiment 3 and Comparison Example.

FIG. 15 is a graph in which a rotation start time of the driving shaft 14 of the apparatus main assembly A is taken as an origin on an abscissa and a magnitude of a torque is represented by an ordinate and in which progression of the torque from the rotational drive of the driving shaft 14. In the graph of (b) of FIG. 15, a solid line represents Comparison Example and shows the torque during unsealing in the case where the sealing member 52 is welded to an entirety of a periphery of the toner supply opening 23*a* as shown in (a) of FIG. 10. Further, in the graph of FIG. 15, a broken line represents Embodiment 3 and shows the torque during unsealing in the constitution in which the sealing member 52 is sandwiched in each of the sandwiching portions M, N.

Of two peaks t1 and t2 where the torque in Comparison Example in FIG. 15 increases, as described in Embodiment 1, the peak t1 is a torque peak in the case where the welding at the fixing portion 23*f* is eliminated, and the peak t2 is a torque peak in the case where the welding at the fixing portion 23*c* is eliminated. Similarly, an increased torque peak t3 in Embodiment 3 (this embodiment) in FIG. 15 shows a torque in the case where the sealing member 52 sandwiched in the sandwiching portion M is disconnected from the sandwiching portion M, and it is understood that compared with t1 in Comparison Example in which the sealing member is welded, the torque becomes small. Further, an increased torque peak T4 in Embodiment 3 (this embodiment) in FIG. 15 shows a torque in the case where the sealing member 52 sandwiched in the sandwiching portion N is disconnected from the sandwiching portion N, and it is understood that compared with t2 in Comparison Example in which the sealing member is welded, the torque becomes small.

From the above, in the constitution in this embodiment, it becomes possible to suppress a torque peak value and thus to suppress a necessary torque as a whole.

Further, comparison and investigation regarding toner leakage from the toner accommodating frame was conducted. As the comparison and investigation regarding the toner leakage, a drop test of the cartridge B was conducted. The drop test is conducted in a packaged state in which the cartridge B is placed in an unused case. Assuming that the cartridge B is transported, the cartridge B is dropped from a height of 100 cm while being in the packaged state, and then whether or not the toner leaks out of the cartridge B is checked. As an object to be compared with that in this embodiment, the cartridge B in the case where the sealing member 52 is welded to the entirety of the periphery of the toner supply opening 23*a* ((a) of FIG. 10) is used similarly as in the case of the measurement of the torque.

In the above-described comparison and investigation, in both of the constitutions in Embodiment 3 and Comparison Example, the toner leakage did not generate, and therefore it was confirmed that the toner T was able to be sealed in the toner accommodating frame 23 with no problem in use.

From the comparison and investigation described above, according to this embodiment, it becomes possible to suppress the torque during unsealing of the sealing member 52 while further preventing the toner leakage from the cartridge B.

Figure 16:
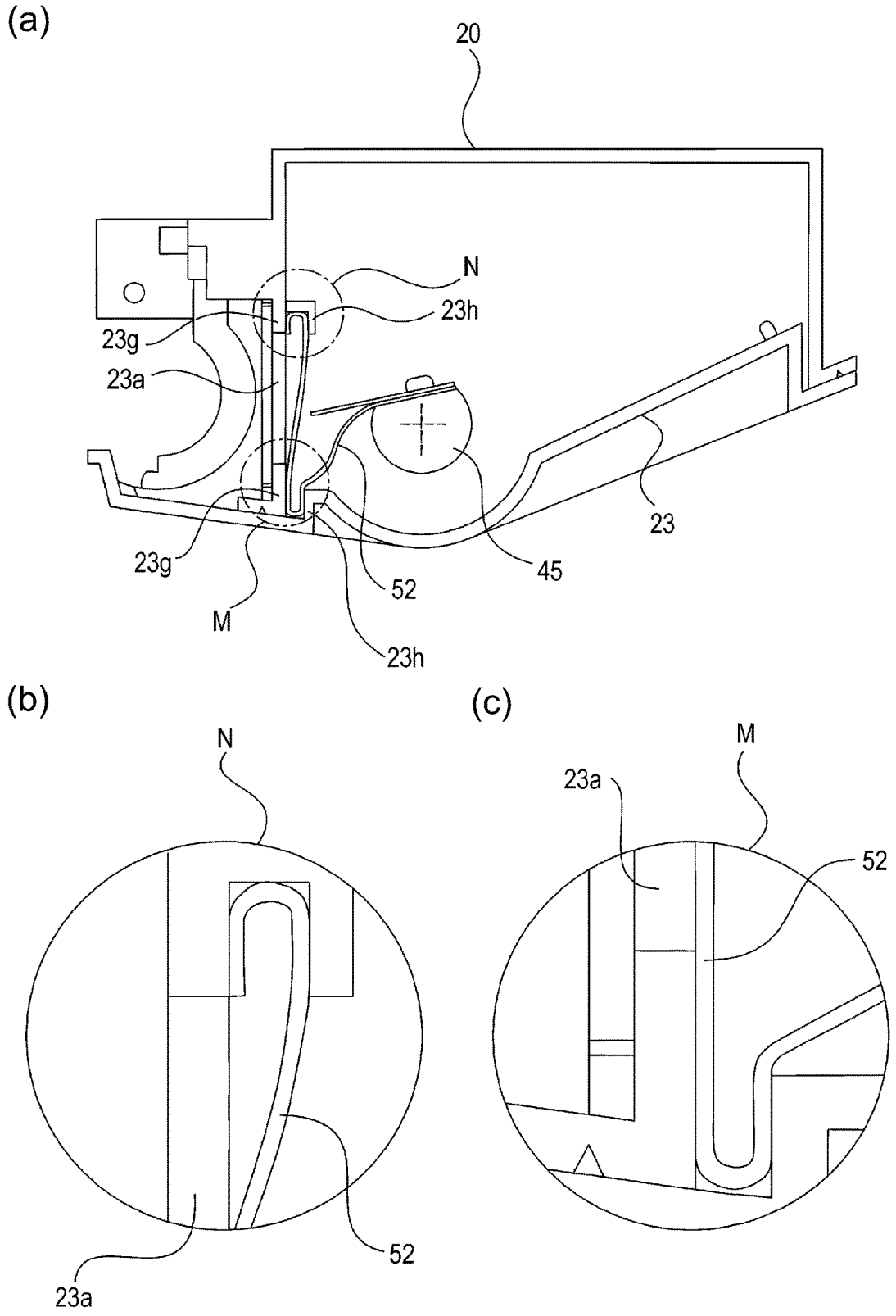
In FIG. 16, (a) to (c) are sectional views of another developing device unit in Embodiment 3.

Further, as shown in FIG. 16, even when a constitution opposite to the constitution shown in FIG. 14 in that a direction of folding back of the sealing member 52 in the sandwiching portion N at the portion above the toner supply opening 23*a* is employed, the torque change device is the same as that in this embodiment, so that an effect similar to the effect of the present invention can be obtained. In this case, at the periphery of the toner supply opening 23*a*, the fixing portion 23*b* is not provided, so that there was no problem also in terms of the toner leakage and therefore an effects similar to the effect of the present invention was obtained.

[Embodiment 4]

Embodiment 4 is characterized in that in addition to the constitution in Embodiment 2 in which the folded-back portion of the sealing member 52 is sandwiched at the portion under the opening, a sandwiching opening M' is made narrower than that in Embodiment 2, so that the sealing member 52 does not readily disconnect from the sandwiching portion M and thus the toner does not readily leak out further by narrowing a sandwiching port M' compared with that in Embodiment 2.

In Embodiment 4, an apparatus main assembly A and an image forming process are the same as those in Embodiment 1, and therefore description of a sandwiching portion M of a developing device unit 20 will be made.

(Sandwiching Portion M)

Figure 17:
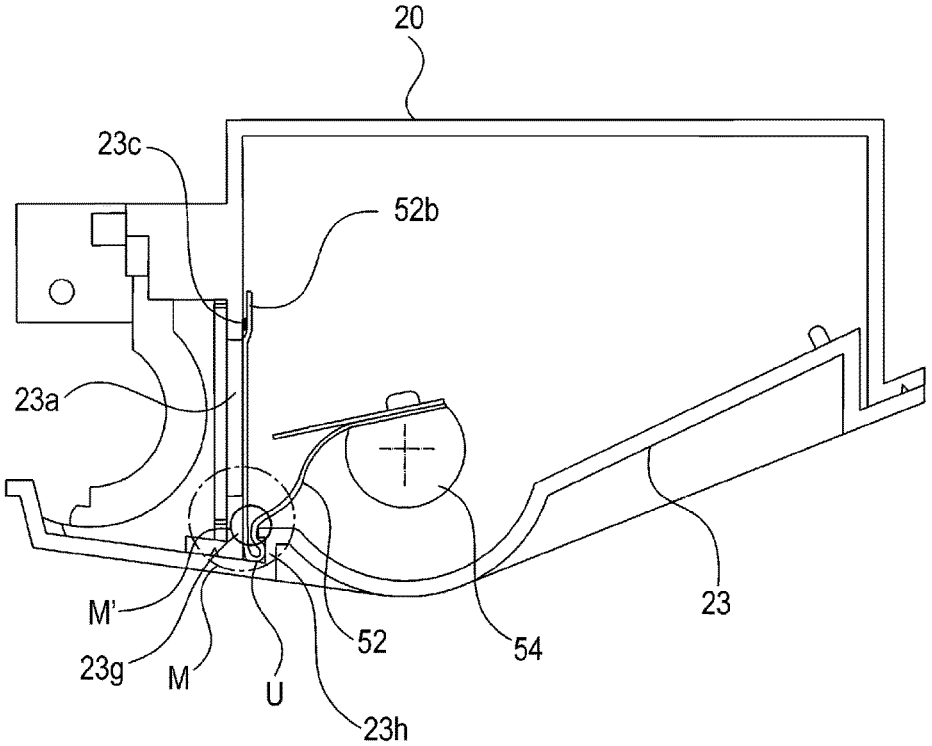
In FIG. 17, (a) and (b) are sectional views of a developing device unit according to Embodiment 4.
Figure 17:
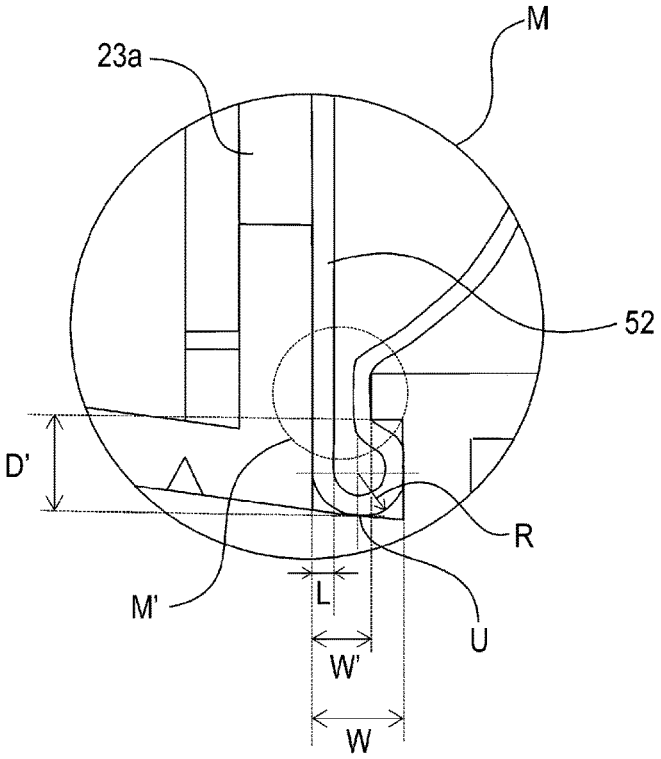

In FIG. 17, (a) and (b) are sectional views of the developing device unit 20 in this embodiment, in which (a) is the sectional view of an entirety of the developing device unit 20 and (b) is an enlarged view showing the folded-back portion U of the sealing member 52 and a sandwiching portion M and the sandwiching port M' in the developing device unit. Cross sections shown in (a) and (b) of FIG. 17 are planes perpendicular to the toner supply opening 23*a*.

In this embodiment, as shown in (a) of FIG. 17, one end portion 52*b* of the sealing member 52 is welded to the fixing portion 23*c* which is a portion on an upper end of the toner supply opening 23*a* and welded to the side fixing portions 23*d*, 23*e* ((a) of FIG. 10). Further, at the sandwiching portion M which is a portion under a lower end of the toner supply opening 23*a*, the sealing member is sandwiched the toner accommodating frame 23 in a state in which the sealing member is folded back with the folded-back portion U as an inflection point thereof. However, depending on a magnitude of the toner supply opening 23*a*, the fixing portions 23*d*, 23*e* are not needed. Further, in Embodiment 4, in addition to the sandwiching of the sealing member 52 in the sandwiching portion M by using the restoring force F as in Embodiment 2, the sandwiching port M' which is an entering port for the sealing member 52 at the sandwiching portion M. Further, a portion, of the sealing member 52, sandwiched at the sandwiching portion M and the sandwiching port M' is not welded in the sandwiching portion as seen in a plane perpendicular to the toner supply opening 23*a*. The sandwiching portion M is constituted by a wall 23*g*, provided with the toner supply opening 23*a*, constituting the toner accommodating frame 23 and a part 23*h*, opposing the wall 23*g*, of the toner accommodating frame 23.

For that reason, as a condition at the sandwiching portion M, when a width of the sandwiching portion M is W and a width of the sandwiching port M' is W', W'>W is satisfied. Further, when the width W' becomes excessively narrow, then the sealing member 52 does not readily disconnect from the sandwiching portion M, and therefore the width W' is required to be not less than twice the thickness L of the sealing member 52. For that reason, as a condition of the width W' of the sandwiching port M', 2L<W'<W is satisfied. Further, when a distance from a lower end portion of the sandwiching port M' to the folded-back portion U of the sealing member 52 is a sandwiching depth D' of the sealing member 52 in the sandwiching portion M, the sandwiching depth D' may only be required to be not less than a radius R of an arcuate portion, i.e., D'>R. This is because, similarly as in Embodiment 2, in the case of D'≤R, the folded-back portion of the sealing member 52 is shallowly sandwiched in the sandwiching portion M and is likely to be restored to the original state by the restoring force F and therefore is liable to disconnect from the sandwiching portion M when is shallowly sandwiched.

From the above, in this embodiment, the depth D of the sandwiching portion M is 10 mm, and the width W of the sandwiching portion M is 5 mm. Further, the width W' of the sandwiching port M' is 2 mm. Further, the thickness L of the sealing member 52 is 100 μm. The material of the sealing member 52 is a flexible material, such as PET, PC or PPS, having an adhesive layer which is melted by heat and thus can be welded to the container. By sandwiching the sealing member 52 in the sandwiching portion M and the sandwiching port M' in a folded-back state, the toner T is prevented from leaking out of the toner accommodating frame 23.

(Verification Experiment)

How a torque (N.m) of the driving shaft 14 during unsealing of the sealing member 52 in this embodiment changes will be verified. As Comparison Example 1, a torque in the case where the sealing member 52 is welded at the fixing portions 23*c*, 23*d*, 23*e*, 23*f* surrounding the toner supply opening 23*a* as shown in (a) of FIG. 10 is shown. As Comparison Example 2, a torque in the case where the sealing member 52 is sandwiched by the restoring force F at the sandwiching portion M in Embodiment 2 (FIG. 11) is shown.

Figure 18:
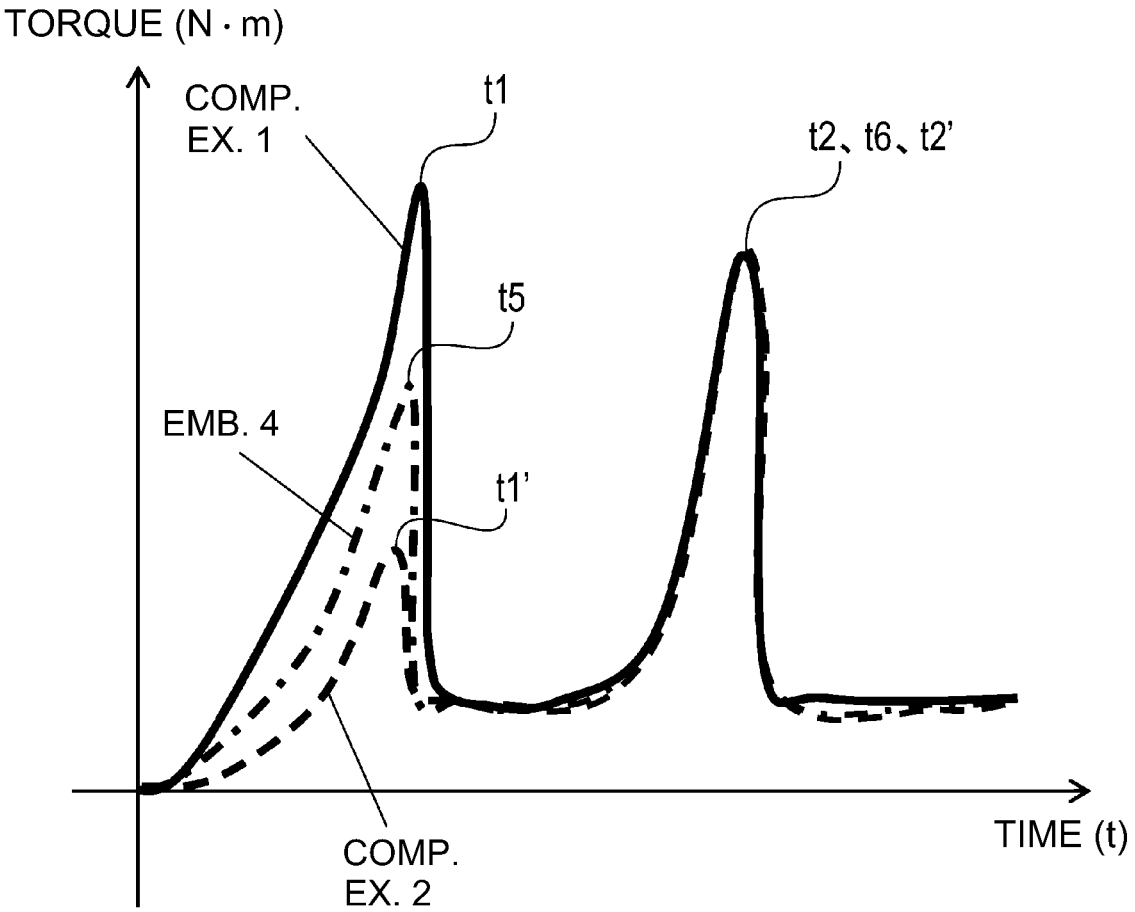
FIG. 18 is a graph showing a result of comparison and investigation of a torque during unsealing of a sealing member in Embodiment 4 and Comparison Examples 1 and 2.

FIG. 18 is a graph in which a rotation start time of the driving shaft 14 of the apparatus main assembly A is taken as an origin on an abscissa and a magnitude of a torque is represented by an ordinate and in which progression of the torque from the rotational drive of the driving shaft 14. In the graph of (b) of FIG. 18, a solid line represents Comparison Example and shows the torque during unsealing in the case where the sealing member 52 is welded to an entirety of a periphery of the toner supply opening 23*a* as shown in (a) of FIG. 10. Further, in the graph of FIG. 18, a broken line represents Comparison Example 2 and shows the torque in the case where the sealing member 52 is sandwiched by the restoring force F at the sandwiching portion M in Embodiment 2. In the graph of FIG. 18, a chain line represents a constitution of Embodiment 4 (this embodiment) and shows the torque during unsealing in the case where the sandwiching port M' is made narrower than the sandwiching portion M.

In FIG. 18, an increased torque peak t5 in this embodiment is the torque in the case where the sealing member 52 sandwiched in the sandwiching portion M disconnects from the sandwiching portion M, and an increased torque peak t6 shows the torque in the case where the sealing member 52 welded to the sandwiching portion 23*c* is peeled off from the fixing portion 23*c*. A torque peak t1 in Comparison Example 1 shows the torque in the case where the sealing member 52 is peeled off from the fixing portion 23*f*, and a torque peak t2 shows the torque in the case where the sealing member 52 is peeled off from the fixing portion 23*c*. Further, a torque peak t1' in Comparison Example 2 is the torque in the case where the sealing member 52 is peeled off from the sandwiching portion M, and a torque peak t2' shows the torque in the case where the sealing member 52 is peeled off from the sandwiching portion 23*c*. Particularly, when the torque peaks t1, t1' and t5 are compared, it is understood that t5 is larger than t1' and is smaller than t1. Further, the torque peaks t2, t2' and t6 have the same constitution, and therefore it is understood that the torques are the same.

From the above, in the constitution in this embodiment, it becomes possible to suppress a torque peak value compared with the case of the welding in Comparison Example 1 and thus to suppress a necessary torque as a whole.

Further, comparison and investigation regarding toner leakage from the toner accommodating frame was conducted. As the comparison and investigation regarding the toner leakage, a drop test of the cartridge B was conducted. The drop test is conducted in a packaged state in which the cartridge B is placed in an unused case. Assuming that the cartridge B is transported, the cartridge B is dropped from a height of 100 cm while being in the packaged state, and then whether or not the toner leaks out of the cartridge B is checked. As an object to be compared with that in this embodiment, as Comparison Example, the cartridge B in the case where the sealing member 52 is welded to the entirety of the periphery of the toner supply opening 23*a* ((a) of FIG. 10) is used similarly as in the case of the measurement of the torque.

In the above-described comparison and investigation, in both of the constitutions in Embodiment 4 and Comparison Example, the toner leakage did not generate, and therefore it was confirmed that the toner T was able to be sealed in the toner accommodating frame 23 with no problem in use.

From the comparison and investigation described above, in the constitution in this embodiment, it becomes possible to suppress the torque during unsealing of the sealing member 52 while further preventing the toner leakage from the cartridge B.

[Embodiment 5]

Embodiment 5 is characterized in that in addition to the constitution in Embodiment 4 in which the sealing member 52 does not readily disconnect from the sandwiching portion M by narrowing the sandwiching port M', the periphery of the sandwiching port M' is formed with a sponge member and the sealing member 52 is sandwiched in a folded-back state. As a result, the torque during unsealing is suppressed while the sealing member 52 does not readily disconnect through the sandwiching port M'.

In Embodiment 5, an image forming apparatus main assembly A and an image forming process are the same as those in Embodiment 1, and therefore description of a sandwiching portion M of a developing device unit 20 will be made.

(Sandwiching Portion M)

Figure 19:
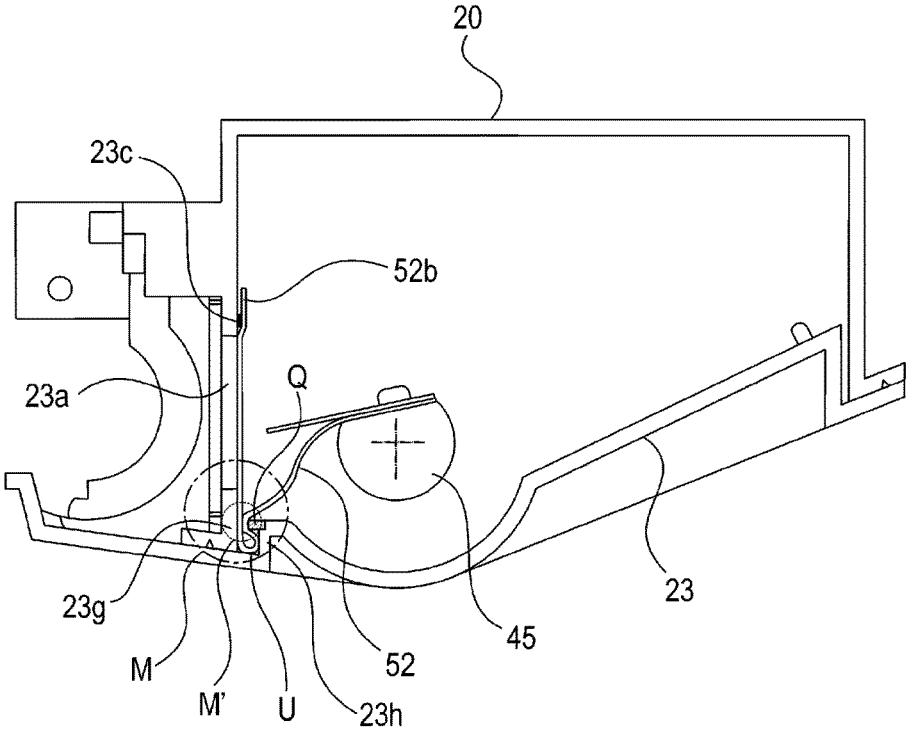
In FIG. 19, (a) and (b) are sectional views of a developing device unit according to Embodiment 5.
Figure 19:
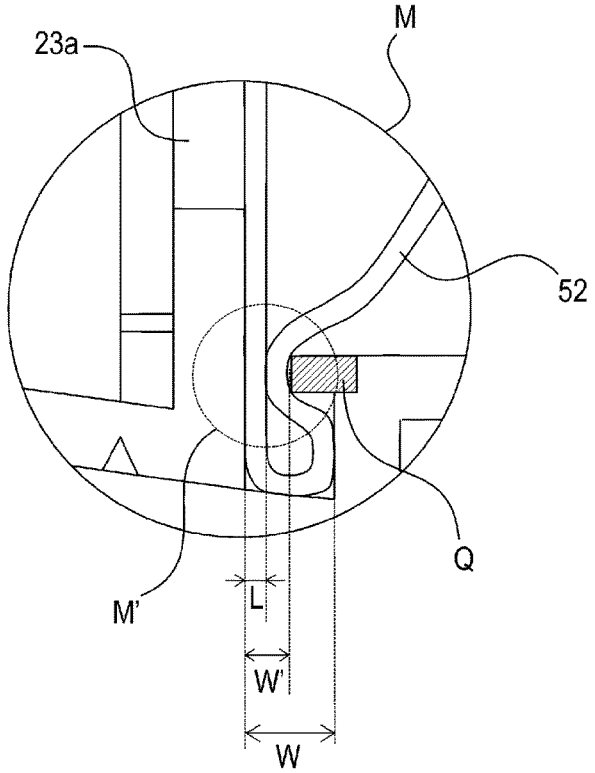

In FIG. 19, (a) and (b) are sectional views of the developing device unit 20 in this embodiment, in which (a) is the sectional view of an entirety of the developing device unit 20 and (b) is an enlarged view showing the folded-back portion U of the sealing member 52, a sandwiching portion M and the sandwiching port M' in the developing device unit. Cross sections shown in (a) and (b) of FIG. 19 are planes perpendicular to the toner supply opening 23*a*.

In this embodiment, as shown in (a) of FIG. 19, one end portion 52*b* of the sealing member 52 is welded to the fixing portion 23*c* which is a portion on an upper end of the toner supply opening 23*a* and welded to the side fixing portions 23*d*, 23*e* ((a) of FIG. 10). However, depending on a magnitude of the toner supply opening 23*a*, the sealing member 52 is not required to be welded at the fixing portions 23*d*, 23*e*. Further, at the sandwiching portion M which is a portion under a lower end of the toner supply opening 23*a*, the sealing member is sandwiched the toner accommodating frame 23 in a state in which the sealing member is folded back with the folded-back portion U as an inflection point thereof. A portion, of the sealing member 52, sandwiched at the sandwiching portion M is not welded in the sandwiching portion M as seen in a plane perpendicular to the toner supply opening 23*a*. In Embodiment 5, as in Embodiment 4, the constitution in which the sandwiching port M' is narrowed and the periphery of the sandwiching port M' is formed with a sponge member Q (hatched portion of FIG. 19) to sandwich the sealing member 52 is employed. The sandwiching portion M is constituted by a wall 23*g*, provided with the toner supply opening 23*a*, constituting the toner accommodating frame 23 and a part 23*h*, opposing the wall 23*g*, of the toner accommodating frame 23. At the sandwiching port M', the wall 23*g* and the sponge member Q oppose each other. For that reason, as a condition of the sandwiching port M', when a width of the sandwiching portion M is W and a width of the sandwiching port M' is W', W'>W is satisfied. In Embodiment 4, the lower limit of the width W' was twice the thickness L of the sealing member 52, but in this embodiment, the periphery of the sandwiching port M' is formed using the sponge member Q, and therefore the lower limit of the width W' can be made further small. However, the width W of the sandwiching portion M is required to be larger than twice the thickness L of the sealing member 52, and therefore there is a need to satisfy 2L<W.

From the above, in this embodiment, as a condition of the sandwiching port M', W'<W and 2L<W are satisfied. Specifically, W=10 mm, W'=5 mm and L=100 μm are set. The material of the sealing member 52 is a flexible material, such as PET, PC or PPS, having an adhesive layer which is melted by heat and thus can be welded to a frame (container).

(Verification Experiment)

How a torque (N.m) of the driving shaft 14 during unsealing of the sealing member 52 in this embodiment changes will be verified. As Comparison Example 1, a torque in the case where the sealing member 52 is welded at the fixing portions 23*c*, 23*d*, 23*e*, 23*f* surrounding the toner supply opening 23*a* as shown in (a) of FIG. 10 is shown. As Comparison Example 2, a torque in the case where the sealing member 52 is sandwiched by the restoring force F at the sandwiching portion M in Embodiment 2 (FIG. 11) is shown.

Figure 20:
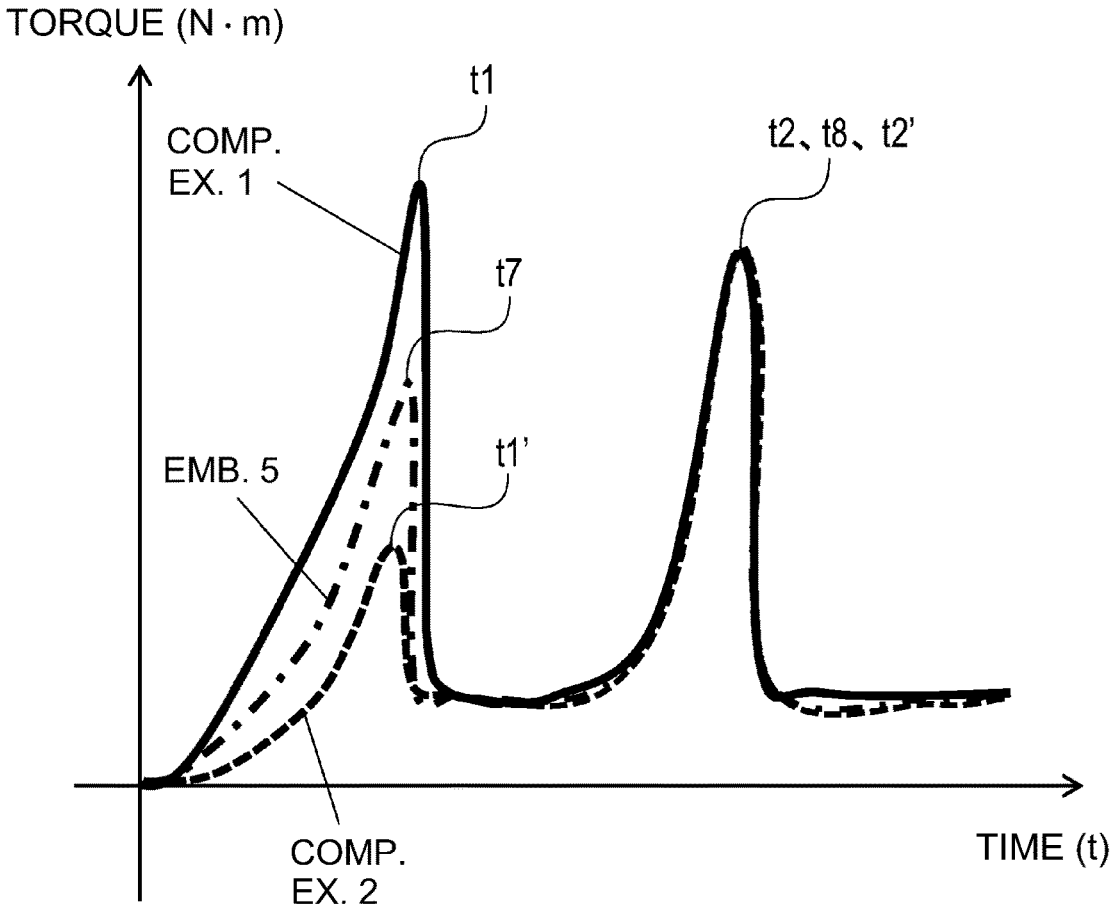
FIG. 20 is a graph showing a result of comparison and investigation of a torque during unsealing of a sealing member in Embodiment 5 and Comparison Examples 1 and 2.

FIG. 20 is a graph in which a rotation start time of the driving shaft 14 of the apparatus main assembly A is taken as an origin on an abscissa and a magnitude of a torque is represented by an ordinate and in which progression of the torque from the rotational drive of the driving shaft 14. In the graph of (b) of FIG. 20, a solid line represents Comparison Example and shows the torque during unsealing in the case where the sealing member 52 is welded to an entirety of a periphery of the toner supply opening 23*a* as shown in (a) of FIG. 10. Further, in the graph of FIG. 20, a broken line represents Comparison Example 2 and shows the torque in the case where the sealing member 52 is sandwiched by the restoring force F at the sandwiching portion M in Embodiment 2. In the graph of FIG. 20, a chain line represents a constitution of Embodiment 4 (this embodiment) and shows the torque during unsealing in the case where the sandwiching port M' is made narrower than the sandwiching portion M and the sponge member Q is used.

In FIG. 20, an increased torque peak t7 in this embodiment is the torque in the case where the sealing member 52 sandwiched in the sandwiching portion M disconnects from the sandwiching portion M, and an increased torque peak t8 shows the torque in the case where the sealing member 52 is peeled off from the fixing portion 23*c*. A torque peak t1 in Comparison Example 1 shows the torque in the case where the sealing member 52 is peeled off from the fixing portion 23*f*, and a torque peak t2 shows the torque in the case where the sealing member 52 is peeled off from the fixing portion 23*c*. Further, a torque peak t1' in Comparison Example 2 is the torque in the case where the sealing member 52 is peeled off from the sandwiching portion M, and a torque peak t2' is the torque in the case where the sealing member 52 is peeled off from the sandwiching portion 23*c*. Particularly, when the torque peaks t1, t1' and t7 are compared, in this embodiment, the sealing member 52 is sandwiched more tightly than in Comparison Example 2 and therefore, it is understood that the torque peak t7 in this embodiment is larger than the torque peak t1' in Comparison Example 2. However, it is understood that compared with the torque peak t1 in Embodiment 1, the torque peak t7 is not the torque peak in the case of the welding and thus is lower than the torque peak t1 as a peak value. Further, the torque peaks t2, t2' and t8 have the same constitution, and therefore it is understood that the torque peaks are the same.

From the above, in the constitution in this embodiment, it becomes possible to suppress a torque peak value compared with the case of the welding in Comparison Example 1 and thus to suppress a necessary torque as a whole.

Further, comparison and investigation regarding toner leakage from the toner accommodating frame 23 was conducted. As the comparison and investigation regarding the toner leakage, a drop test of the cartridge B was conducted. The drop test is conducted in a packaged state in which the cartridge B is placed in an unused case. Assuming that the cartridge B is transported, the cartridge B is dropped from a height of 100 cm while being in the packaged state, and then whether or not the toner leaks out of the cartridge B is checked. As an object to be compared with that in this embodiment, as Comparison Example, the cartridge B in the case where the sealing member 52 is welded to the entirety of the periphery of the toner supply opening 23*a* ((a) of FIG. 10) is used similarly as in the case of the measurement of the torque.

In the above-described comparison and investigation, in both of the constitutions in Embodiment 5 and Comparison Example, the toner leakage did not generate, and therefore it was confirmed that the toner T was able to be sealed in the toner accommodating frame 23 with no problem in use.

From the comparison and investigation described above, in the constitution in this embodiment, it becomes possible to suppress the torque during unsealing of the sealing member 52 while further preventing the toner leakage from the cartridge B.

[Embodiment 6]

Embodiment 6 is characterized in that different from Embodiment 5 in which the periphery of the sandwiching port M' is formed with the sponge member Q, the sponge member Q is mounted to define the opening to sandwich the sealing member 52.

In Embodiment 6, an apparatus main assembly A and an image forming process are the same as those in Embodiment 1, and therefore description of a sandwiching portion M of a developing device unit 20 will be made.

(Sandwiching Portion M)

Figure 21:
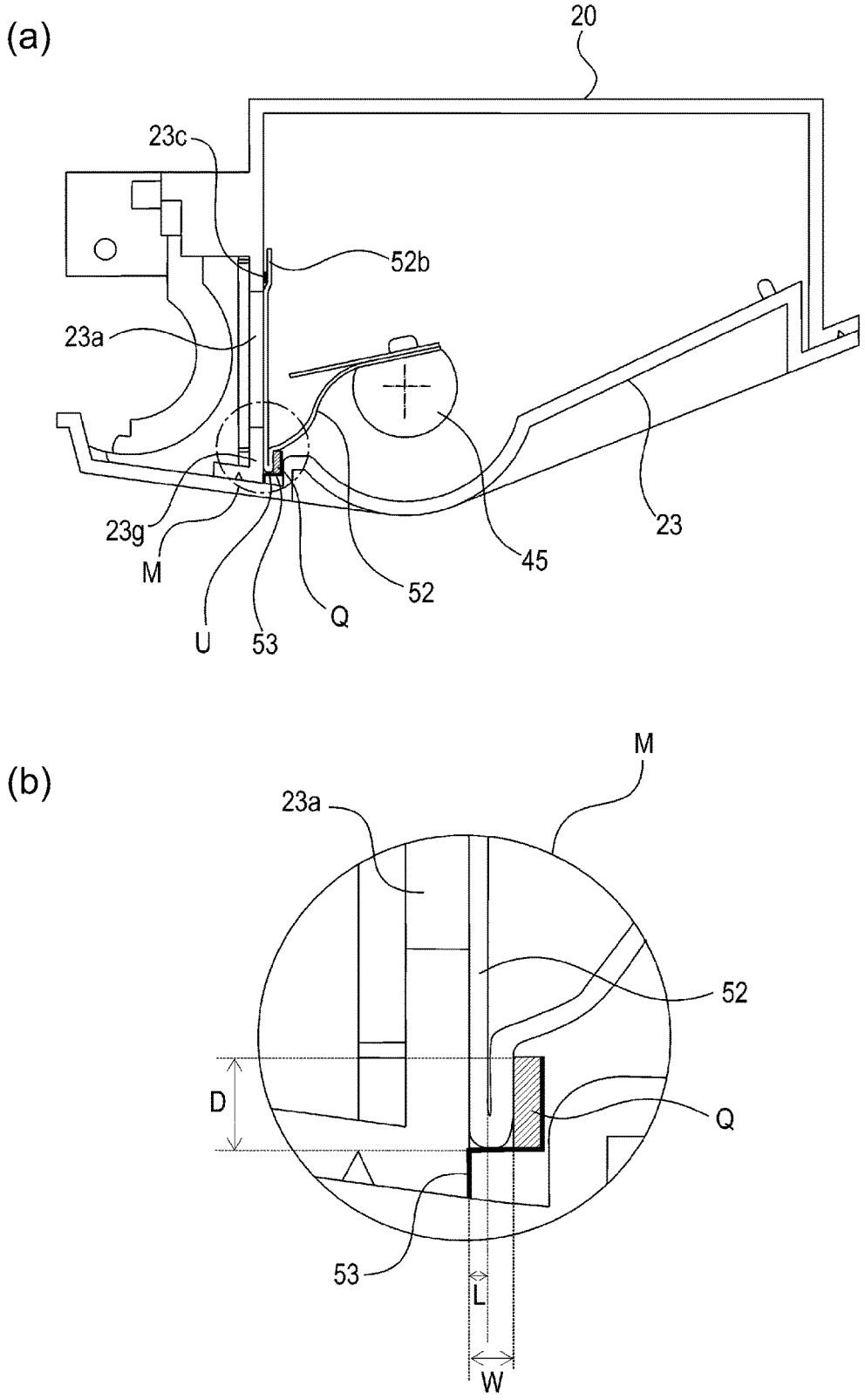
In FIG. 21, (a) and (b) are sectional views of a developing device unit according to Embodiment 6.

In FIG. 21, (a) and (b) are sectional views of the developing device unit 20 in this embodiment, in which (a) is the sectional view of an entirety of the developing device unit 20 and (b) is an enlarged view showing the folded-back portion U of the sealing member 52 and a sandwiching portion M in the developing device unit. Cross sections shown in (a) and (b) of FIG. 21 are planes perpendicular to the toner supply opening 23*a*.

In this embodiment, as shown in (a) of FIG. 21, one end portion 52*b* of the sealing member 52 is welded to the fixing portion 23*c* which is a portion on an upper end of the toner supply opening 23*a* and welded to the side fixing portions 23*d*, 23*e* ((a) of FIG. 10). Further, at the sandwiching portion M which is a portion under a lower end of the toner supply opening 23*a*, the sealing member is sandwiched in a state in which the sealing member is folded back at the folded-back portion U. However, depending on a magnitude of the toner supply opening 23*a*, the sealing member 52 is not particularly required to be welded at the fixing portions 23*d*, 23*e*. Further, a portion, of the sealing member 52, sandwiched by the sandwiching portion M is not welded (i.e., nonwelded) in the sandwiching portion M when the sealing member 52 is seen on a plane perpendicular to the toner supply opening 23*a*.

Further, in this embodiment, an assisting member 53 is provided at a portion blow the toner supply opening 23*a* and then the sponge member Q is mounted on the assisting member 53. The sponge member Q is assisted by the assisting member 53 from a side opposite from a contact portion with the sealing member 52. The sandwiching portion M is constituted by the wall 23*g*, provided with the toner supply opening 23*a*, constituting the toner accommodating frame 23 and by the sponge member Q provided opposed to the wall 23*g*. Then, the folded-back portion of the sealing member 52 is sandwiched by the wall 23*g* and the sponge member Q, so that the sealing member 52 does not readily disconnect from the sandwiching portion M and thus the toner leakage is prevented. Further, in this embodiment, the assisting member 53 is provided using a SUS plate as shown in FIG. 21 and is fixed with a double-side tape at the portion below the toner supply opening 23*a*. When the width of the sandwiching portion M is W and the thickness of the sealing member 52 is L, in this embodiment, as a condition in which the sealing member 52 is sandwiched by the width 23*g* and the sponge member Q, $2L>W$ is satisfied. Specifically, in this embodiment, the width W of the sandwiching portion M and the thickness L of the sealing member 52 are 180 μm and 100 μm, respectively. The material of the sealing member 52 is a flexible material, such as PET, PC or PPS, having an adhesive layer which is melted by heat and thus can be welded to a frame (container).

(Verification Experiment)

How a torque (N.m) of the driving shaft 14 during unsealing of the sealing member 52 in this embodiment changes will be verified. As Comparison Example 1, a torque in the case where the sealing member 52 is welded at the fixing portions 23*c*, 23*d*, 23*e*, 23*f* surrounding the toner supply opening 23*a* as shown in (a) of FIG. 10 is shown. As Comparison Example 2, a torque in the case where the sealing member 52 is sandwiched by the restoring force F at the sandwiching portion M in Embodiment 2 (FIG. 11) is shown.

Figure 22:
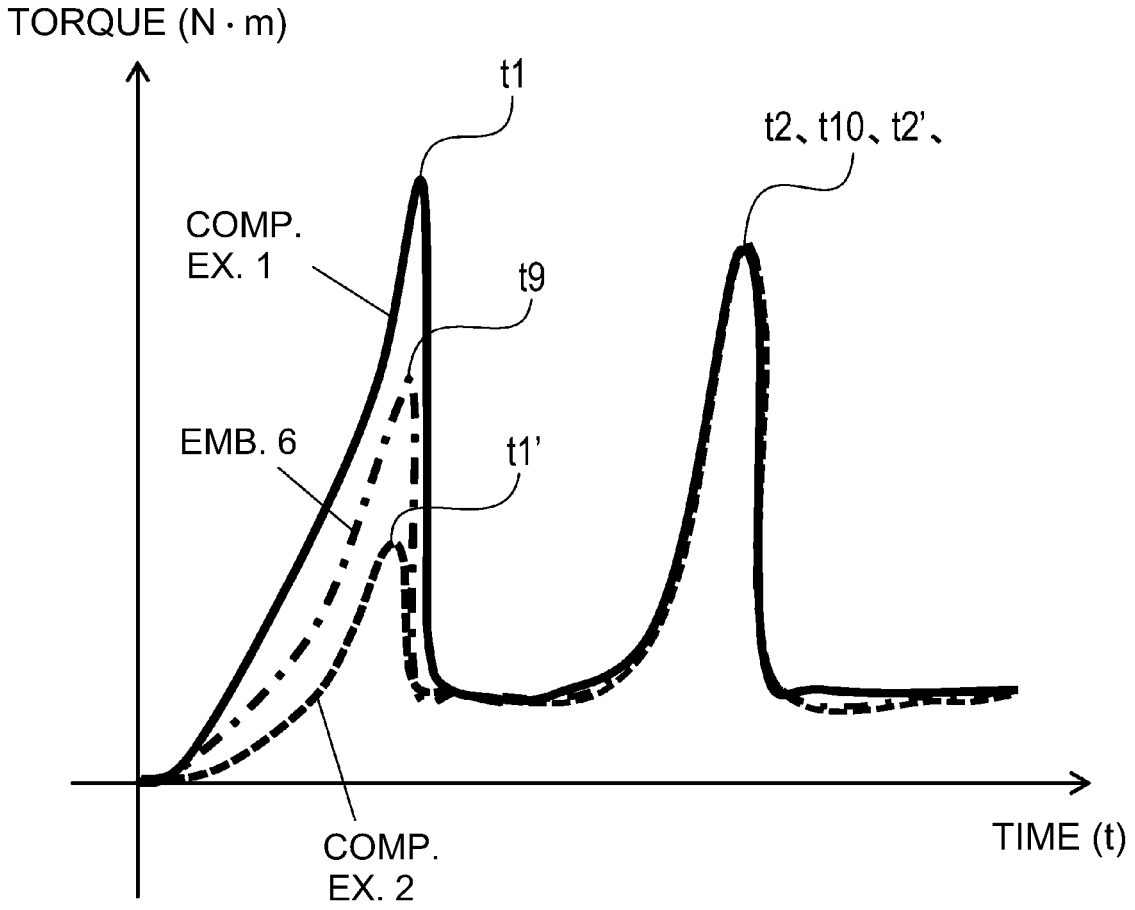
FIG. 22 is a graph showing a result of comparison and investigation of a torque during unsealing of a sealing member in Embodiment 6 and Comparison Examples 1 and 2.

FIG. 22 is a graph in which a rotation start time of the driving shaft 14 of the apparatus main assembly A is taken as an origin on an abscissa and a magnitude of a torque is represented by an ordinate and in which progression of the torque from the rotational drive of the driving shaft 14. In the graph of (b) of FIG. 22, a solid line represents Comparison Example and shows the torque during unsealing in the case where the sealing member 52 is welded to an entirety of a periphery of the toner supply opening 23*a* as shown in (a) of FIG. 10. Further, in the graph of FIG. 22, a broken line represents Comparison Example 2 and shows the torque in the case where the sealing member 52 is sandwiched by the restoring force F at the sandwiching portion M in Embodiment 2. In the graph of FIG. 22, a chain line represents a constitution of Embodiment 4 (this embodiment) and shows the torque during unsealing in the case where the sandwiching sealing member 52 is sandwiched using the sponge member Q mounted on the assisting member 53.

In FIG. 22, a torque peak t9 in this embodiment is the torque in the case where the sealing member 52 sandwiched using the sponge member Q disconnects from the sandwiching portion M, and a torque peak t10 is the torque in the case where the sealing member 52 is peeled off from the fixing portion 23*c*. A torque peak t1 in Comparison Example 1 is the torque in the case where the sealing member 52 is peeled off from the fixing portion 23*f*, and a torque peak t2 is the torque in the case where the sealing member 52 is peeled off from the fixing portion 23*c*. Further, a torque peak t1' in Comparison Example 2 is the torque in the case where the sealing member 52 is peeled off from the sandwiching portion M, and a torque peak t2' is the torque in the case where the sealing member 52 is peeled off from the sandwiching portion 23*c*. When the torque peaks t1, t1' and t9 are compared, it is understood that the torque peak t9 is larger than the torque peak t1 in the case of the welding. Further, in this embodiment, the sealing member 52 is sandwiched more tightly than in Comparison Example 2 and therefore it is understood that the torque peak t9 is larger than the torque peak t1' in Comparison Example 2. Further, the torque peaks t2, t2' and t10 have the same constitution, and therefore it is understood that the torques are the same.

From the above, in the constitution in this embodiment, it becomes possible to suppress a torque peak value compared with the case of the welding in Comparison Example 1 and thus to suppress a necessary torque as a whole.

Further, comparison and investigation regarding toner leakage from the toner accommodating frame 23 was conducted. As the comparison and investigation regarding the toner leakage, a drop test of the cartridge B was conducted. The drop test is conducted in a packaged state in which the cartridge B is placed in an unused case. Assuming that the cartridge B is transported, the cartridge B is dropped from a height of 100 cm while being in the packaged state, and then whether or not the toner leaks out of the cartridge B is checked. As an object to be compared with that in this embodiment, as Comparison Example, the cartridge B in the case where the sealing member 52 is welded to the entirety of the periphery of the toner supply opening 23*a* ((a) of FIG. 10) is used similarly as in the case of the measurement of the torque.

In the above-described comparison and investigation, in both of the constitutions in Embodiment 6 and Comparison Example, the toner leakage did not generate, and therefore it was confirmed that the toner T was able to be sealed in the toner accommodating frame 23 with no problem in use.

From the comparison and investigation described above, in the constitution in this embodiment, it becomes possible to suppress the torque during unsealing of the sealing member 52 while further preventing the toner leakage from the cartridge B.

[Other Embodiments]

In the above-described embodiments, the process cartridge including the developing device unit was described as an example, but the present invention is not limited thereto. Separately from the process cartridge including the photosensitive drum, a developing device detachably mountable to the image forming apparatus main assembly may also be independently provided. Alternatively, a developer container such as a toner bottle including the toner accommodating frame provided with the opening and the sealing member for sealing the opening may also be used.

In the above-described embodiments, as the process cartridge detachably mountable to the image forming apparatus main assembly, a process cartridge prepared by integrally assembling the photosensitive drum and, as the process means actable on the photosensitive drum, the charging means, the developing means and the cleaning means into a unit was described as an example. However, the present invention is not limited thereto. The process cartridge may also be a process cartridge integrally including in addition to the photosensitive drum and the developing means, either one of the charging means and the cleaning means as a unit.

Further, in the above-described embodiments, as the image forming apparatus, the printer was described as an example, but the present invention is not limited thereto. For example, other image forming apparatuses such as a copying machine, a facsimile machine and a multi-function machine having a combination of functions as these machines may also be used. By applying the present invention to these image forming apparatuses, a similar effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-105995 filed on May 26, 2015, which is hereby incorporated by reference herein in its entirety.

What is claimed is:

1. A developer container comprising:

a frame, provided with an opening, for accommodating developer;

a sealing member for sealing the opening;

a rotatable member rotatable to wind up said sealing member; and a sandwiching portion for sandwiching a part of said sealing member, wherein in a state in which said part of said sealing member is folded back in said sandwiching portion and before said rotatable member starts to rotate, said part of said sealing member is nonwelded in said sandwiching portion.

2. A developer container according to claim 1, wherein said frame includes a stirring member, mounted on said rotatable member, for feeding the developer toward the opening while stirring the developer, and wherein said sealing member is mounted on said rotatable member at one end portion thereof, and said sealing member and said stirring member are simultaneously rotatable by rotation of said rotatable member.

3. A developer container according to claim 1, wherein when a depth of said sandwiching portion before said folded back portion is sandwiched is D, a width of said sandwiching portion is W and a thickness of said sealing member is L, a condition of the width W of said sandwiching portion is $2L<W<5L$.

4. A developer container according to claim 1, wherein, when a depth of said sandwiching portion before said folded back portion is sandwiched is D, a driving of said sandwiching portion before said folded back portion is sandwiched is L, a width of said sandwiching portion is W and a radius of an arcuate portion of said folded back portion is R, D>R and 2R>W are satisfied.

5. A developer container according to claim 3, wherein when a width of a sandwiching opening, which is an entrance opening of said sealing member, of said sandwiching portion is W', a condition of the width W' of the sandwiching opening is 2L<W'<W.

6. A developer container according to claim 5, wherein when a distance from a lower end of the sandwiching opening to said folded back portion of said sealing member is D', and a radius of an arcuate portion of said folded back portion is R, D'>R is satisfied.

7. A developer container according to claim 5, wherein a periphery of the sandwiching opening is formed with a sponge member, and said sealing member is sandwiched by said sponge member.

8. A developer container according to claim 1, wherein said sandwiching portion is constituted by a wall, provided with the opening, constituting said frame and a part of said frame opposing said wall.

9. A developer container according to claim 1, wherein said sandwiching portion is constituted by a wall, provided with the opening, constituting said frame and a sponge member provided opposite to said wall.

10. A developer container according to claim 9, wherein said sponge member is assisted by an assisting member from an opposite side from a contact portion with said sealing member.

11. A developer container according to claim 10, wherein said assisting member is formed with a SUS plate and is fixed to said wall, provided with the opening, with a double side tape.

12. A developer container according to claim 2, further comprising a filling port through which the developer is to be filled, wherein said filling port is provided on a side closer to the opening than a center of an axis of said rotatable member is, and said filling port is provided above a rotation locus of said rotatable member.

13. A developer container according to claim 1, wherein said sandwiching portion is provided at a portion under a lower end of the opening, and said sealing member is sandwiched in said sandwiching portion so that said folded back portion is a bottom of said sandwiching portion.

14. A developer container according to claim 13, wherein said sandwiching portion is further provided at a portion on an upper end of the opening, and said sealing member is sandwiched in said sandwiching portion so that said folded back portion is a top of said sandwiching portion.

15. A developer container according to claim 1, wherein said sealing member includes a portion to be fixed to a part of said frame.

16. A developing device comprising:

a developer container according to claim 1; and a developer carrying member for carrying the developer.

17. A process cartridge comprising:

a developer container according to claim 1; and a developer carrying member for carrying the developer.

18. An image forming apparatus for forming an image on a recording material with developer, said image forming apparatus comprising:

a developer container according to claim 1.

* * * * *